US011040855B2

(12) United States Patent
Gorzalczynski

(10) Patent No.: US 11,040,855 B2
(45) Date of Patent: Jun. 22, 2021

(54) EMERGENCY BRAKING SYSTEM FOR MINE SHAFT CONVEYANCE

(71) Applicant: Wabi Iron & Steel Corp., New Liskeard (CA)

(72) Inventor: Stan Gorzalczynski, Haileybury (CA)

(73) Assignee: WABI IRON & STEEL CORP., New Liskeard (CA)

( * ) Notice: Subject to any disclaimer, the term of this patent is extended or adjusted under 35 U.S.C. 154(b) by 313 days.

(21) Appl. No.: 16/098,762

(22) PCT Filed: May 2, 2017

(86) PCT No.: PCT/CA2017/050532

§ 371 (c)(1),
(2) Date: Nov. 2, 2018

(87) PCT Pub. No.: WO2017/190235

PCT Pub. Date: Nov. 9, 2017

(65) Prior Publication Data

US 2019/0062112 A1 Feb. 28, 2019

Related U.S. Application Data

(60) Provisional application No. 62/331,115, filed on May 3, 2016.

(51) Int. Cl.
*B66B 5/18* (2006.01)
*B66B 5/04* (2006.01)

(52) U.S. Cl.
CPC ..... *B66B 5/18* (2013.01); *B66B 5/044* (2013.01)

(58) Field of Classification Search
CPC ..... B66B 5/18; B66B 5/044; B66B 5/16
See application file for complete search history.

(56) References Cited

U.S. PATENT DOCUMENTS 3,762,512 A * 10/1973 McIntyre ..... B66B 5/22 188/189
5,265,701 A * 11/1993 Ogasawara ..... B66B 5/18 187/254

(Continued)

FOREIGN PATENT DOCUMENTS

| | | |
|---|---|---|
| EP | 2221267 | 8/2010 |
| JP | 2009113914 A | 5/2009 |
| WO | 2003070615 | 8/2003 |

OTHER PUBLICATIONS

International Search Report and Written Opinion #1 for PCT/CA2017/050532 dated Aug. 18, 2017.
Written Opinion #2 for PCT/CA2017/050532 dated Jun. 11, 2018.

*Primary Examiner* — Michael A Riegelman

(57) ABSTRACT

In one aspect, a clamp for installation onto an elevator car as part of an emergency braking system comprises: a clamp body having an L-shaped profile with a vertical portion for attachment to an elevator car wall of the elevator car and horizontal portion for attachment to an elevator car roof or an elevator car floor of the elevator car; and a pair of opposing brakes disposed on the vertical portion of the clamp body for clamping a mine shaft guide between the brakes for emergency braking. In another aspect, a method of activating an emergency brake of an elevator car comprises: sensing a load of the elevator car; based on the sensed load, dynamically determining a rate at which an emergency brake shall be incrementally engaged; and upon detecting a freefall or overspeed condition of the elevator car, incrementally engaging the emergency brake at the dynamically determined rate.

12 Claims, 15 Drawing Sheets

(56) References Cited

U.S. PATENT DOCUMENTS

| | | | | | |
|---|---|---|---|---|---|
| 5,648,644 | A * | 7/1997 | Nagel | B66B 5/18 | 187/288 |
| 5,782,319 | A * | 7/1998 | Woodruff | B66B 5/22 | 187/376 |
| 6,161,653 | A * | 12/2000 | Skalski | B66B 5/04 | 187/305 |
| 2012/0205198 | A1* | 8/2012 | Okada | B66B 5/22 | 187/350 |
| 2012/0211311 | A1* | 8/2012 | Piech | B66B 5/16 | 187/351 |
| 2013/0062149 | A1* | 3/2013 | Burgoon | F16D 55/227 | 188/72.3 |
| 2013/0105248 | A1* | 5/2013 | Martinelli | B66B 1/32 | 187/288 |
| 2014/0216857 | A1* | 8/2014 | Mizuno | B66B 5/22 | 187/359 |
| 2014/0224594 | A1* | 8/2014 | Billard | B66B 5/18 | 187/359 |
| 2014/0299425 | A1* | 10/2014 | Schautt | F16D 55/2245 | 188/158 |
| 2015/0240894 | A1* | 8/2015 | Piech | F16D 63/008 | 188/163 |
| 2015/0259175 | A1* | 9/2015 | West | F16D 63/008 | 187/359 |
| 2017/0101292 | A1* | 4/2017 | Powers | B66B 5/22 | |
| 2018/0127238 | A1* | 5/2018 | Guo | H01H 3/16 | |
| 2018/0297814 | A1* | 10/2018 | Shiraishi | B66B 5/044 | |
| 2019/0062112 | A1* | 2/2019 | Gorzalczynski | B66B 5/18 | |

* cited by examiner

EMERGENCY BRAKING SYSTEM FOR MINE SHAFT CONVEYANCE

CROSS REFERENCE TO RELATED APPLICATIONS

The present application is a national stage entry, under 35 U.S.C. Section 371, of International Application No. PCT/CA2017/050532, filed May 2, 2017, which claims the benefit of U.S. Provisional Patent Application No. 62/331,115 filed on May 3, 2016, the entire disclosure of each of which is hereby incorporated by reference hereinto.

TECHNICAL FIELD

The present disclosure relates to mine shaft conveyances, and more particularly to emergency braking systems for mine shaft conveyances.

BACKGROUND

In the mining industry, it is typical for an underground mine to be accessed from surface level via a vertical mine shaft using a mine shaft conveyance or "cage." A mine cage may be considered as a form of elevator car. The cage may be made from metal and may have a substantially cuboid shape. The cage is typically suspended from a metal cable, which may be colloquially referred to as a "hoist rope" or simply as a "rope." The rope is used to convey (raise and lower) the mine cage within the mine shaft.

Cages vary in size and weight. A small cage may weigh as little as 2,000 pounds, whereas a large cage may weigh as much as 80,000 pounds. The floor or "deck" of a cage may measure eight feet wide by twenty feet long, in one example embodiment. A cage may have a single deck or multiple decks stacked vertically for increased load capacity.

Cages commonly carry cargo, mining personnel, or both. The loads carried by a cage may vary from trip to trip. For example, on some occasions, a cage may convey 170 people at once. Estimating 200 pounds per person, this represents a cargo of approximately 34,000 pounds. On other occasions, the cage may be occupied only by a single person, e.g. the cage operator or "cage tender," who may weigh only 200 pounds or thereabouts. On still other occasions, the cage may be heavily loaded with cargo, which may weigh tens of tons.

A mine cage is conveyed up and down a mine shaft along vertical guide members or rails referred to as shaft guides. Shaft guides are typically attached to opposing faces of a mine shaft, on opposite sides of a cage. A shaft guide may have a rectangular cross-section and may be made from wood or from steel. In the latter case, the steel may be tubular. The cage may have rollers or other guide means for tracking the shaft guides during ascent or descent.

If a mine cage rope severs, the cage can go into freefall. Given typical mine shaft depths, which are currently in the range of 5,000 to 8,500 feet and are increasing, a cage freefall may have catastrophic results. Even when a cable is not severed, a cage may be subject to conditions, such as "slack rope" conditions (e.g. resulting from cage hang-ups in the mine shaft), resulting in a sudden drop (when the hang-up resolves) followed by a sudden deceleration (when the rope slack is taken up). Such a sudden deceleration may impart significant forces (e.g. multiple Gs) upon the cage. As with mine cage freefall, these forces may damage cargo and may be harmful or fatal for human occupants. At least for that reason, cage freefall, and slack rope or "overspeed" conditions are generally undesirable.

Some mine cages employ emergency arrest mechanisms designed to decelerate or stop the cage when a freefall or overspeed condition occurs. Such emergency arrest mechanisms have historically employed safety dogs. A safety dog is a spring-loaded mechanism which is mounted onto a mine cage. During normal mine cage operation, the safety dog is retracted and the mine cage is raised or lowered freely. In an emergency freefall condition, the safety dog deploys, causing a downwardly inclined, chisel-like tooth to engage and dig into the adjacent mine shaft guide.

An emergency braking system typically incorporates two safety dogs per mine shaft guide. Safety dogs rely on excavation of shaft guide material, e.g. digging a furrow into the shaft guide, in order to decelerate the mine cage. Thus safety dogs are primarily or exclusively used with wooden shaft guides.

Safety dogs may be considered disadvantageous for various reasons.

Firstly, safety dogs are not well-suited for use with steel mine shaft guides, which are too hard for the tooth/teeth of a conventional safety dog to dig into. Thus, use of safety dogs may force a mine operator to use wooden shaft guides. Yet wooden shaft guides may be considered inferior to steel shaft guides for various reasons, such as inconsistent material uniformity (e.g. due to knots in wood), inferior material strength relative to steel, and difficulty of acquisition/purchase of suitable wooden shaft guides.

Secondly, safety dogs damage wooden shaft guides when deployed. Wooden shaft guides also tend to degrade or lose structural integrity over time. Ultimately, wooden shaft guides may need to be replaced, which is costly and results in mine shaft downtime.

Thirdly, a mine cage whose movement is arrested by safety dogs may not experience a smooth deceleration but rather may experience a series of jolts which may be harmful for cargo and unpleasant for, or harmful to, human occupants. For example, jolting deceleration may occur when the tooth or teeth of a safety dog cause(s) a length of wood comprising the shaft guide to splinter or split vertically. When that occurs, as the mine cage decelerates, the safety dog tooth or teeth may periodically enter the free space of the vertical split, which offers no resistance and thus no braking force. In that case, the mine cage may experience a moment of acceleration until the safety dog once again digs into wood. Another possible consequence of a splitting shaft guide is the application of a significant and possibly damaging lateral load onto an opposing mine shaft guide. This may occur when one safety dog has caused its shaft guide to split while an opposing safety dog is braking effectively. The uneven braking forces on opposite sides of the mine cage may cause the cage to abruptly tilt away from vertical, or to swing, within the mine shaft. Inconsistencies in wooden shaft guides (e.g. varying moisture content, cracks, knots) may similarly result in inconsistent mine cage deceleration.

An alternative emergency arrest mechanism to the safety dog is the Blair hoist. A Blair hoist uses two hoist ropes to raise and lower an elevator car. Both ropes share in carrying the rope end load. The theory behind Blair hoists is that the likelihood of dual rope failure is extremely low. As such, Blair hoists may employ no other emergency arrest mechanisms. Put another way, the low probability of complete severance of both ropes may be considered to obviate the need for "on-board" safety arrest mechanisms.

The Blair hoist wraps both ropes onto a drum at the same time typical to single rope drum hoisting. This mode of operation separates Blair hoisting from the more conventional multi-rope Koepe (friction) hoist in that lifting force is not transferred to the hoist rope through frictional contact. The primary advantage of Blair hoists over friction hoists is that the former, unlike the latter, does not require any balancing "tail ropes" to be suspended from the underside of the shaft conveyance to balance the suspended loads on either side of the hoist. Such suspended tail ropes may be considered to undesirably limit the useful hoisting depth of friction hoist systems to approximately 5000 feet, due to entanglement of the tail ropes induced by the Coriolis effect of the Earth's rotation.

A possible disadvantage of Blair hoists is their installation and operational cost. The complexity of Blair hoist systems may require or warrant an increased maintenance staff size, significant infrastructure provisions and high energy usage to operate. Installation costs alone may increase the hoist plant cost by ten million dollars relative to equivalent installations using single rope hoisting technology.

A further alternative emergency arrest mechanism to the safety dog and the Blair hoist is the mechanical gripping wedge, a mechanism commonly used on industrial cargo elevators. A mechanical gripping wedge is an inverted wedge that is deployed in the event of elevator car freefall, which causes instantaneous capture of the elevator car. Mechanical gripping wedges have gradually been accepted into the mining industry in view of a belief that rope severance generally occurs when the elevator car is ascending in the hoist way. In such scenarios, energy transfer upon instantaneous capture of the elevator car does not have a significant downward velocity component, and G-forces on any occupants within the car tends to be negligible.

However, it is also possible for a rope to sever while the car is descending. In that case, mechanical gripping wedges would be poorly suited for safely arresting a mine cage. This is in view of the significant G forces that would likely be imparted upon the downwardly falling elevator car upon its instantaneous capture by the mechanical gripping wedge, which may damage cargo and may result in injury or fatality to human occupants.

SUMMARY

In one aspect of the present disclosure, there is provided a clamp for installation at a right angle junction of a roof and an adjacent wall of a substantially cuboid-shaped mine shaft conveyance as part of an emergency braking system of the mine shaft conveyance, the clamp comprising: a pair of L-shaped brackets, in like orientation and occupying parallel planes, spaced apart in fixed relation to one another; and a pair of opposing brakes disposed on corresponding respective legs of the pair of L-shaped brackets, the pair of opposing brakes for clamping a mine shaft guide between the brakes for emergency braking; wherein the corresponding legs of the pair of L-shaped brackets on which the pair of opposing brakes is disposed are attached to a first plate defining a vertical mounting face of the clamp and wherein the remaining two legs of the pair of L-shaped brackets are attached to a second plate defining a horizontal mounting face of the clamp; and wherein the vertical mounting face meets the horizontal mounting face at a right angle to facilitate mounting of the clamp to the mine shaft conveyance at the right angle junction of the roof and the wall of the mine shaft conveyance through attachment of the horizontal mounting face to the roof of the mine shaft conveyance and attachment of the vertical mounting face to the wall of the mine shaft conveyance.

In another aspect of the present disclosure, there is provided an emergency braking system for a mine shaft conveyance, the system comprising: a brake; a control system for, upon detection of a mine shaft conveyance freefall or overspeed condition, incrementally engaging the brake at an incremental brake engagement rate; and a load cell, coupled to the control system, for sensing a load of the mine shaft conveyance, wherein the control system is operable to dynamically set the incremental brake engagement rate based, at least in part, upon the load of the mine shaft conveyance as sensed by the load cell.

In yet another aspect of the present disclosure, there is provided a method of activating an emergency brake of a mine shaft conveyance, the method comprising: sensing a load of the mine shaft conveyance; based on the sensed load of the mine shaft conveyance, dynamically determining a rate at which an emergency brake shall be incrementally engaged; and upon detecting a freefall or overspeed condition of the mine shaft conveyance, incrementally engaging the emergency brake at the dynamically determined rate.

In a further aspect of the present disclosure, there is provided a method of installing an emergency braking system onto a substantially cuboid-shaped mine shaft conveyance, the method comprising: positioning a clamp at a right angle junction of a roof and an adjacent wall of the mine shaft conveyance, the clamp including: a pair of L-shaped brackets, in like orientation and occupying parallel planes, spaced apart in fixed relation to one another; and a pair of opposing brakes disposed on corresponding respective legs of the pair of L-shaped brackets, the pair of opposing brakes for clamping a mine shaft guide between the brakes for emergency braking; wherein the corresponding legs of the pair of L-shaped brackets on which the pair of opposing brakes is disposed are attached to a first plate defining a vertical mounting face of the clamp and wherein the remaining two legs of the pair of L-shaped brackets are attached to a second plate defining a horizontal mounting face of the clamp, the vertical mounting face meeting the horizontal mounting face at a right angle; attaching the vertical mounting face to the wall of the mine shaft conveyance; and attaching the horizontal mounting face to the roof of the mine shaft conveyance.

BRIEF DESCRIPTION OF THE DRAWINGS

In the figures which illustrate example embodiments.

DETAILED DESCRIPTION

In this document, the term "exemplary" should be understood to mean "an example of" and not necessarily to mean that the example is preferable or optimal in some way.

Figure 1:
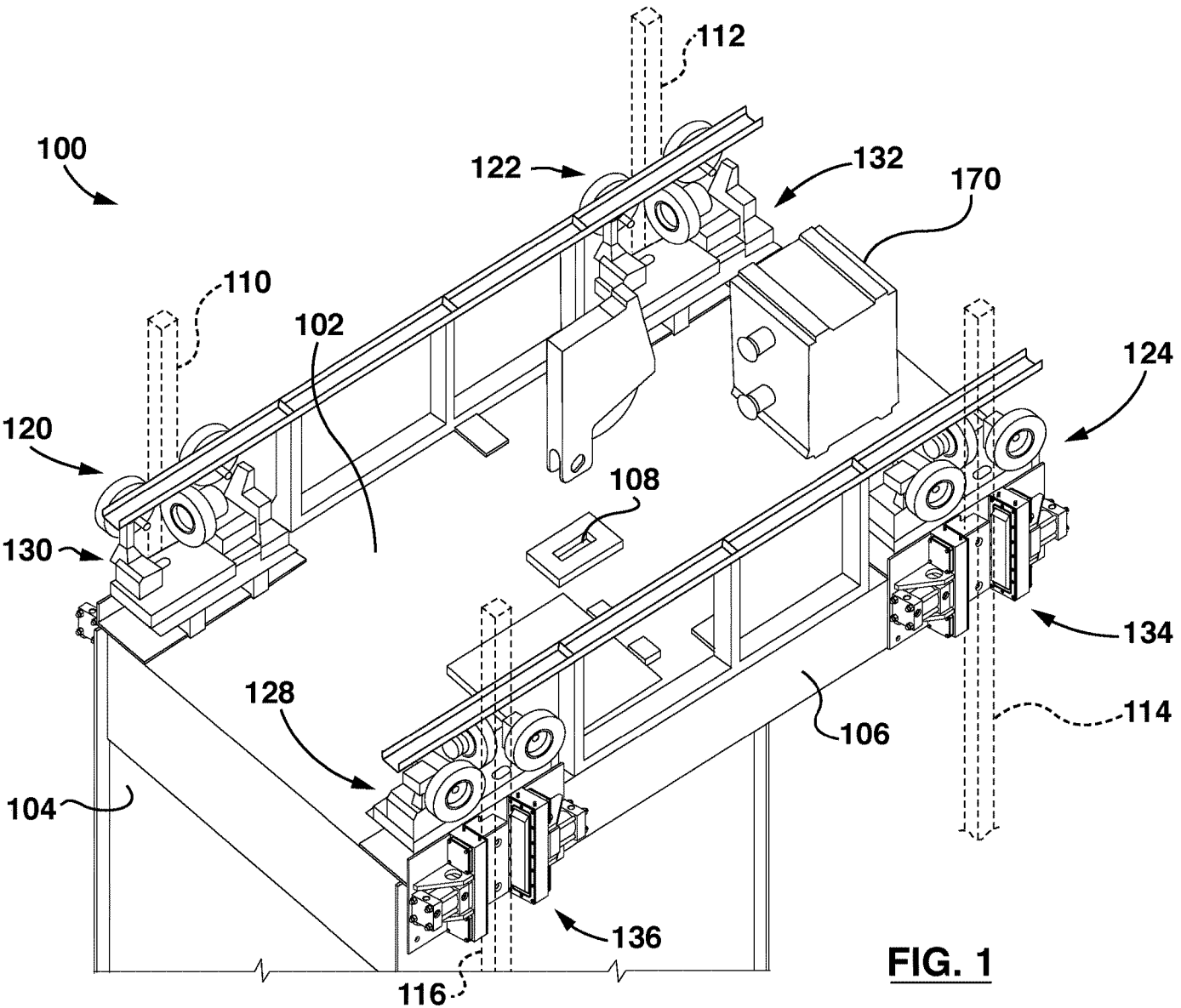
FIG. 1 is a top perspective view of an upper portion of a mine elevator car equipped with an emergency braking system.

Referring to FIG. 1, an upper portion of an exemplary mine elevator car 100 (a form of mine shaft conveyance) equipped with an emergency braking system is illustrated in top perspective view. The elevator car 100 (also referred to herein as a "mine cage") has a generally cuboid shape, a rectangular roof 102, a rear wall 104 and a truncated front wall 106. The truncated front wall 106 may constitute a header for a door (not expressly depicted) used for ingress to and egress from the elevator car 100.

A slot 108 in the roof accommodates a tang (not illustrated in FIG. 1) to which a hoist cable (also not depicted in FIG. 1), for raising and lowering the elevator car 100, is attached. The tang is attached to the elevator car 100 car by way of a spring-loaded drawbar, described below. The drawbar incorporates a triggering mechanism for activating the emergency braking system. The triggering mechanism and the emergency braking system will both be described in more detail below.

The elevator car 100 travels along a plurality of shaft guides 110, 112, 114 and 116, which are depicted in FIG. 1 using dashed lines. Each of the shaft guides is a vertical member or rail having a rectangular cross-section and is affixed to the mine shaft walls.

In this embodiment, there are two shaft guides 110, 112 on the rear side of the elevator car 100 and two shaft guides 114, 116 on the front side of the elevator car 100. The four shaft guides are at or near the corners of the rectangular elevator car roof 102. The number of mine shaft guides, their shape, and their placement relative to the corners of the elevator car roof 102 may vary in alternative embodiments.

Four guide roller assemblies 120, 122, 124 and 126 are mounted atop the roof 102 at the location of shaft guides 110, 112, 114 and 116 respectively. The guide roller assemblies facilitate low friction guided movement of the elevator car 100 up or down the shaft guides within the mine shaft.

Four clamps 130, 132, 134 and 136 are also mounted atop the elevator car 100 at the location of the shaft guides 110, 112, 114 and 116 respectively. The clamps are components of the emergency braking system. Each of the 130, 132, 134 and 136 is designed to clamp onto a respective shaft guide when the elevator car 100 enters a freefall or overspeed condition. The clamps are mounted to the elevator car 100 at a right angle junction of the elevator car roof 102 and the adjacent wall 104 or 106. This is described in more detail below.

FIGS. 2-7 provide various views a single example clamp 200. It will be appreciated that the clamp depicted in these figures is shown in a disengaged condition, i.e. as it appears when emergency braking is not being performed. It will further be appreciated that each of clamps 130, 132, 134 and 136 of FIG. 1 is an instance of the example clamp 200 shown in FIGS. 2-7.

Referring initially to FIGS. 2-5, the exemplary clamp 200 is shown in perspective view, side elevation view, top plan view, and front elevation view, respectively. The clamp 200 has a right angle or "L-shaped" profile that is characterized by a horizontal portion 202 and a vertical portion 204 (see e.g. FIG. 3). The L-shaped profile allows the clamp to be attached at the right-angle junction of the elevator car roof and an elevator car wall. In particular, the horizontal portion 202 of the clamp 200 is for attachment to the elevator car roof 102, and the vertical portion 204 of the clamp 200 is for attachment to the elevator car wall 104. This design may enhance the ability of the clamp 200 to withstand significant G forces during emergency braking with minimal damage or wear, as will be described.

The example clamp 200 incorporates a pair of L-shaped brackets 210, 212 (see e.g. FIG. 2) in like orientation, spaced apart in fixed relation to one another, occupying parallel planes (i.e. the opposing faces of the brackets are parallel). The pair of L-shaped brackets 210, 210 is thus defined by a pair of corresponding, parallel vertically oriented legs 214, 216 and a pair of corresponding, parallel horizontally oriented legs 218, 220 (see e.g. FIG. 2).

Figure 2:
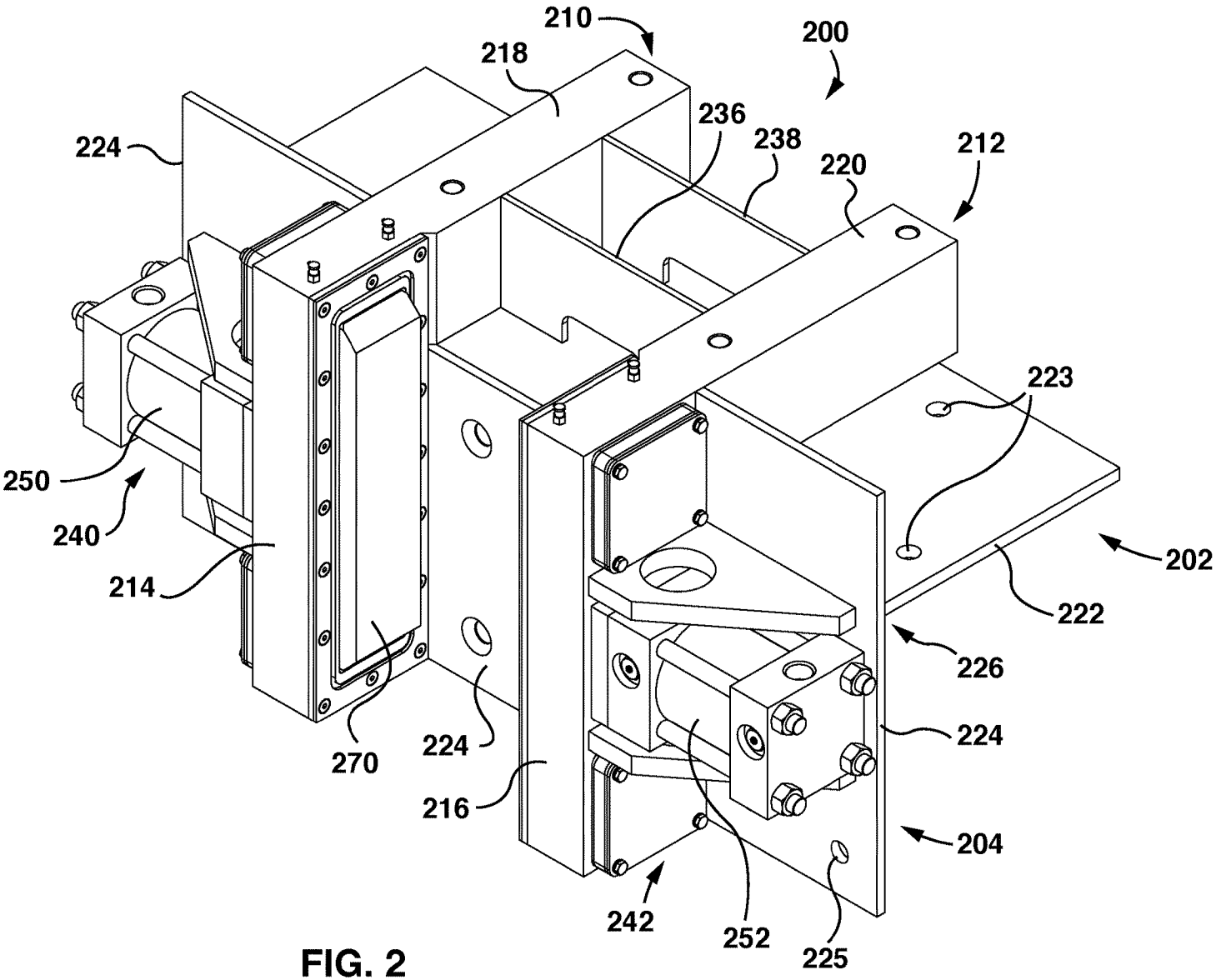
FIGS. 2, 3, 4 and 5 are a perspective view, side elevation view, top plan view, and front elevation view, respectively, of a clamp component of the emergency braking system of FIG. 1.
Figure 3:
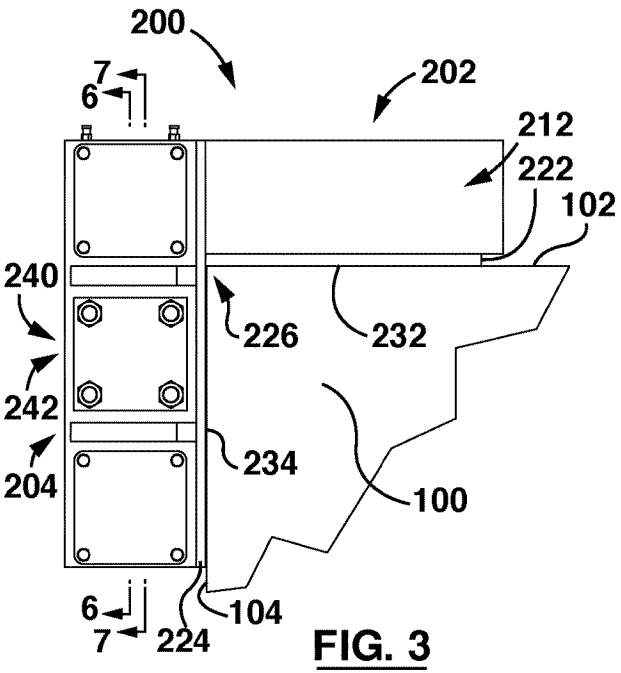

The example clamp 200 further includes a horizontal bracket plate 222 and a vertical bracket plate 224, which meet at a right angle 226 (see e.g. FIGS. 2 and 3). The horizontal bracket plate 222 defines a horizontal mounting face 232 (FIG. 3) for attachment to the elevator car roof 102 via a plurality of attachment points. In this embodiment, the attachment points are holes 223 defined in the plate 222 for receiving bolts or other fasteners (see e.g. FIGS. 2 and 4). Similarly, the vertical bracket plate 224 defines a vertical mounting face 234 (FIG. 3) for attachment to the elevator car wall 104 via a plurality of attachment points, which in this embodiment are holes 225 defined in the plate 224 for receiving bolts or other fasteners (see e.g. FIGS. 2 and 5). The plates 222, 224 are not necessarily of the same thickness.

Figure 4:
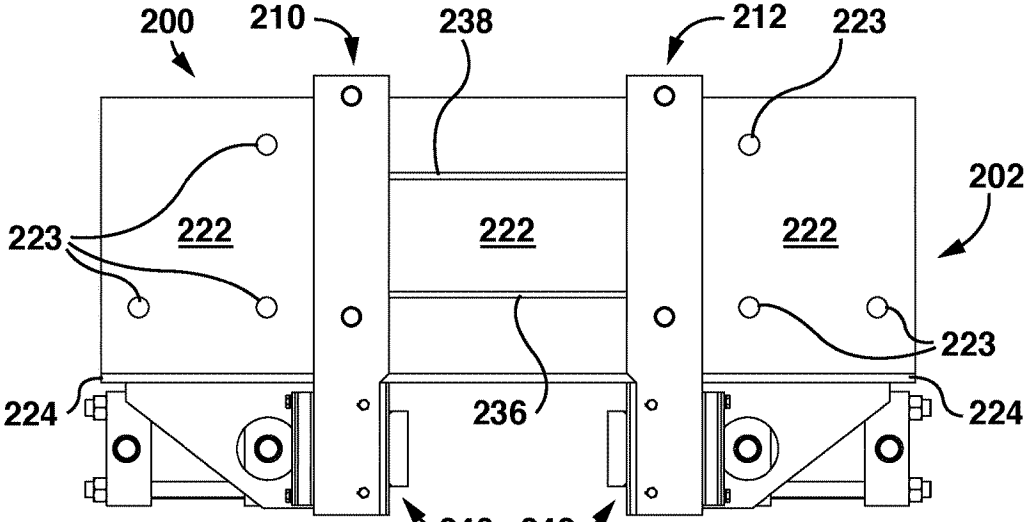
Figure 5:
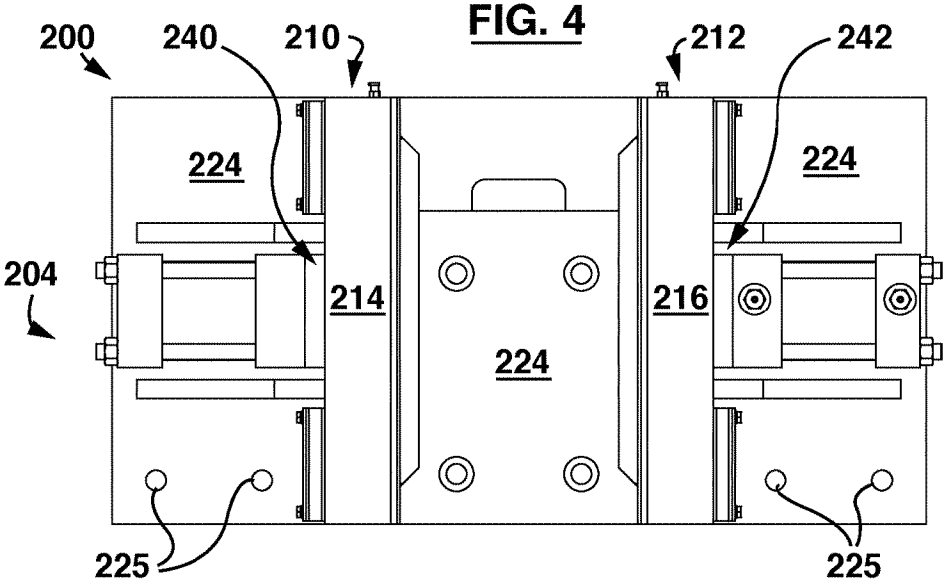

A pair of parallel upstanding stabilizing ribs or plates 236, 238 extends transversely between the L-shaped brackets 210, 212 atop horizontal bracket plate 222 (see FIGS. 2 and 4). The ribs 236, 238 contribute to the structural integrity of the clamp 200.

The pair of L-shaped brackets 210, 212, the horizontal bracket plate 222, the vertical bracket plate 224, and the stabilizing ribs 236, 238 may all be made from the same material, e.g. a metal such as aluminum, and may be welded together for example.

In the present embodiment, each of L-shaped brackets 210, 212 is at least six times thicker than a thickest one of the horizontal bracket plate 222 and vertical bracket plate 224. Moreover, each of the stabilizing ribs 236, 238 is half as thick as the thinnest one of plates 222 and 224. These relative thicknesses may strike a favorable compromise between maximizing clamp strength while minimizing clamp weight.

The clamp 200 further includes a pair of opposing brakes 240, 242 for clamping a mine shaft guide therebetween (see e.g. FIGS. 2 to 5). The brakes 240, 242 are disposed on the vertical portion 204 of the clamp body. In this embodiment, each brake 240, 242 is disposed on a vertically oriented leg 214, 216 of one of the L-shaped brackets 210, 212, respectively. The pair of brakes 240, 242 is disposed mostly below the horizontal portion 202 of the clamp body in this embodiment (see e.g. FIGS. 2 and 3).

The brakes 240, 242, which are hydraulic brakes in this embodiment, are oriented horizontally to facilitate clamping of a vertical mine shaft guide disposed between the brakes. As such, the hydraulic cylinder 250, 252 of each respective brake 240, 242 is mounted horizontally onto the vertical portion 204 of the clamp 200 (see e.g. FIG. 2).

Figure 6:
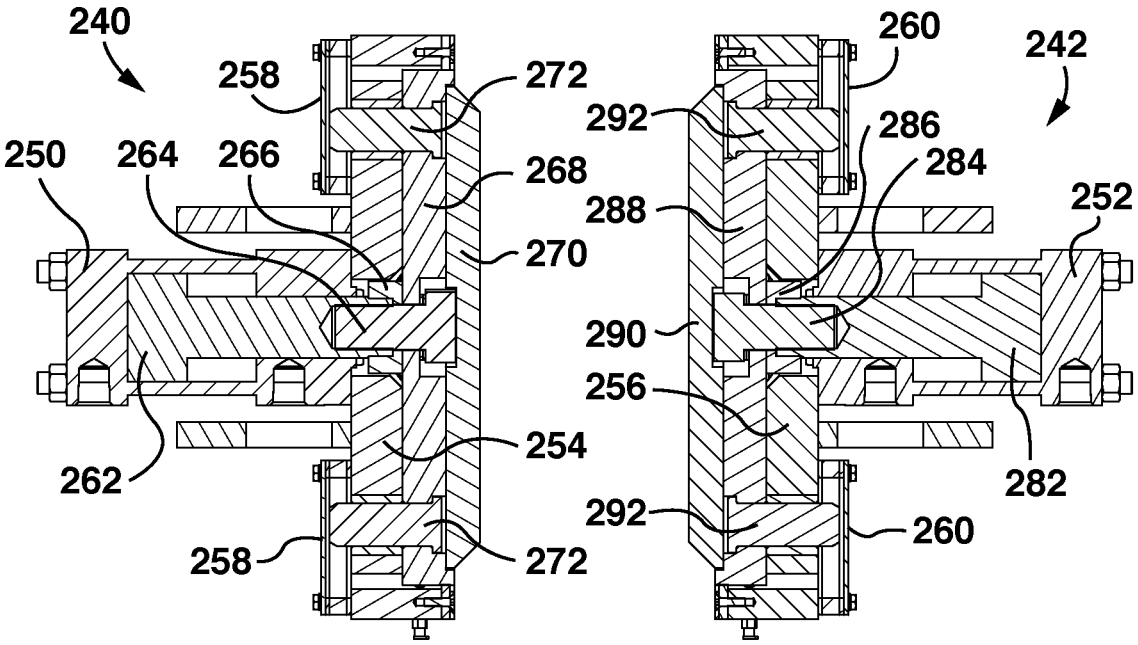
FIGS. 6 and 7 are cross-sectional views taken at lines 6 and 7, respectively, of the clamp of FIG. 3.
Figure 7:
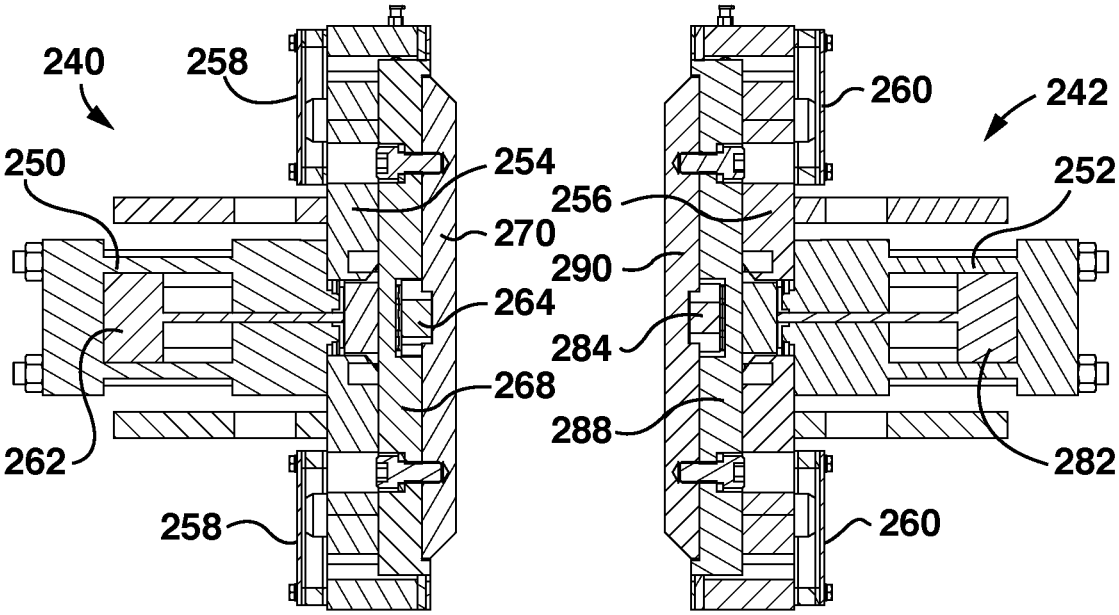

The various components comprising brakes 240, 242 are shown in greater detail in the cross-sectional views of FIGS. 6 and 7, which are taken at lines 6 and 7, respectively, of FIG. 3. As illustrated, each brake 240, 242 is made up of multiple components generally classifiable into two subsets: fixed components and moving components.

Fixed components are components of a brake 240 or 242 that do not move relative to the body of clamp 200 when the brake is engaged and disengaged. The fixed components of brakes 240, 242 include hydraulic cylinders 250, 252, clamp plates 254, 256 and cover plates 258, 260, respectively.

Moving components are components of a brake 240 or 242 that move relative to the body of clamp 200 as the brake is engaged and disengaged. The moving components of brake 240, which move (translate horizontally in FIGS. 6 and 7) as a unit referred to as brake shoe 241, include piston 262, bolt 264, cylinder collar 266, wear shoe mount plate 268, wear shoe 270 and alignment pins 272. Similarly, the moving components of brake 242, which also move (translate in an opposite direction to the opposing brake shoe 241) as a unit referred to as brake shoe 243, include piston 282, bolt 284, cylinder collar 286, wear shoe mount plate 288, wear shoe 290 and alignment pins 292.

The alignment pins 272, 292 may alternatively be referred to as guide pins or guide dowels. A pair of alignment pins 272, 292 flanks each piston 262, 282 respectively. Each of the alignment pins 272 is received in a respective guide hole through clamp plate 254. Similarly, each of the alignment pins 292 is received in a respective guide hole through clamp plate 256. The guide holes may be carefully machined so as to be transverse (perpendicular) to their respective clamp plates 254, 256 and to precisely accommodate alignment pins 272, 292, within narrow tolerances. This may promote reliable extension and retraction of each brake shoe 241, 243 by movement of the single respective piston 262, 282 driving each brake shoe.

For example, the linear or dimensional tolerance of the alignment pins 272, 292 with respect to their guide holes (e.g. the difference between the outer diameter of each pin and the inner diameter of its respective hole) may be in the range of several thousandths of an inch. The geometric tolerance of each alignment pin with respect to the mount plate 268, 288 from which it extends may be in the range of one half to one ten-thousandth of an inch, to ensure that the pin extends precisely perpendicularly from the mount plate and precisely aligned with its respective hole in the adjacent clamp plate.

If the tolerances were too wide, there may be an unacceptably high risk of binding of the brake shoes 241, 243. This is in view of the single cylinder 250, 252 driving each respective brake shoe 241, 243. In particular, if the cylinder that drives a brake shoe should become even slightly misaligned above or below horizontal, the respective piston could be driven on a slight angle, which could in turn result in binding of the alignment pins within their horizontal guide holes. Use of tight tolerances discourages this from happening while allowing only a single (sole) centrally disposed cylinder of the brake to be used to engage the brake. This may advantageously limit clamp weight and complexity. As such, the design of clamp 200 may be considered to represent a good compromise between limiting clamp weight and ensuring reliable clamp operability.

The above-described single cylinder design is in comparison to a hypothetical brake design that uses, for each brake, a pair of cylinders (one at the location of each of the pair of alignment pins shown in FIGS. 6 and 7) and a single central alignment pin (at the central location of the piston shown in FIGS. 6 and 7). Such a hypothetical design may be considered less risky, i.e. reliable even with wider linear and geometric tolerances of the retaining pin and its associated hole, since any binding of the central alignment pin may be resolved by the pistons in turn "walking" or wobbling the alignment pin and brake shoe out into a deployed state. However, the hypothetical two-cylinder brake would come at the cost of significantly more weight than a one-cylinder brake design as shown in FIGS. 6 and 7.

As should now be apparent from FIGS. 6 and 7 and the foregoing description, each of the brakes 240, 242 comprises a respective brake shoe 241, 243. Brake shoe 241 includes a wear shoe mount plate 268, a sole piston 262 extending orthogonally and centrally from a back face of the wear shoe mount plate 268, and a pair of alignment pins 272 flanking the piston 262 and extending orthogonally from the back face of the wear shoe mount plate 268. Similarly, brake shoe 243 includes a wear shoe mount plate 288, a sole piston 282 extending orthogonally and centrally from a back face of the wear shoe mount plate 288, and a pair of alignment pins 292 flanking the piston 282 and extending orthogonally from the back face of the wear shoe mount plate 288. The clamp body of clamp 200 comprises a respective guide hole for slidably receiving each of the alignment pins 272, 292. In some embodiments, the geometric tolerance of each of the alignment pins with respect to its respective guide hole may be approximately one-half of to one ten thousandth of an inch (i.e. one twenty thousandth to one ten thousandth of an inch), and the linear tolerance of each of the alignment pins with respect to its respective guide hole may be approximately several thousandths of an inch.

Figure 8:
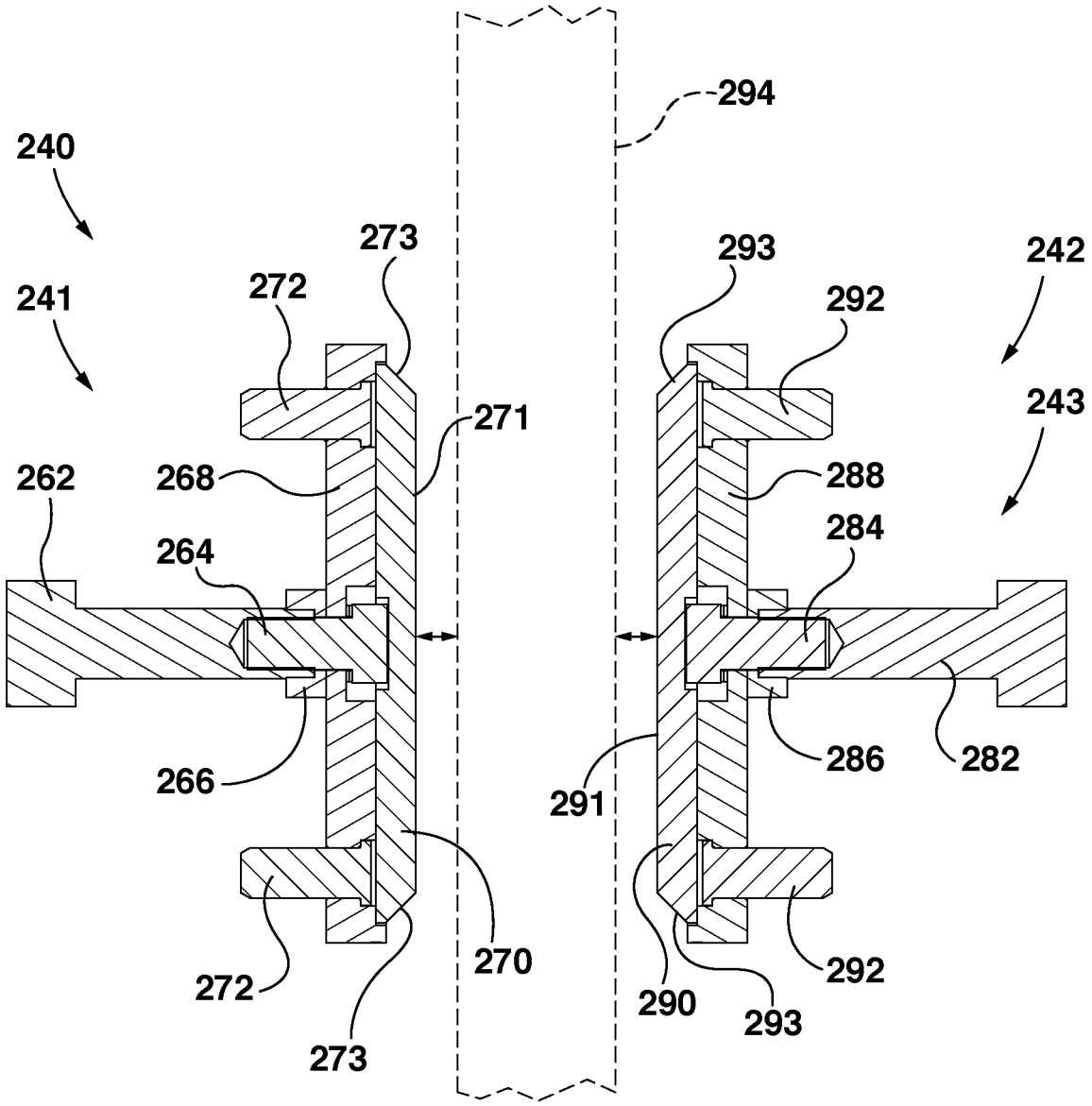
FIG. 8 is a cross-sectional view of the brake shoe components of the clamp of FIGS. 6 and 7.

FIG. 8 is a cross-sectional view of only the brake shoes 241, 243 of brakes 240, 242 respectively. As illustrated, the brake shoes 241, 243 are horizontally translatable between a disengaged position (shown in FIG. 8), in which the wear shoe 270, 290 of each respective brake shoe 241, 243 is retracted away from a shaft guide 294 disposed between the brakes 240, 242, and an engaged position in which the wear shoe 270, 290 of each respective brake shoe 241, 243 is advanced inwardly until it engages (is pressed firmly against) a respective side of the shaft guide 294.

Each of the wear shoes 270, 290 has a respective flat face 271, 291 that is oriented substantially vertically, i.e. substantially parallel to the vertical shaft guide 294 against which the wear shoes 270, 290 will be pressed when the brakes are engaged (see e.g. FIG. 8). Each of the flat faces 271, 291 accordingly occupies a plane that is perpendicular to both of the horizontal mounting face 232 and the vertical mounting face 234 of the clamp 200 (see FIG. 3).

Referring again to FIG. 8, each wear shoe 270, 290 has tapered ends 273, 293 respectively. The tapered ends 273, 293 allow the wear shoes to serve as guide shoes when the brake is not engaged. In other words, should the wear shoes 270, 290 inadvertently buffet the shaft guides during normal elevator car ascent or descent while the brakes are disengaged, the wear shoes will not present any notable obstruction but rather will behave as a guide wear shoe. The tapered ends may also limit damage to the wear shoe in the event that the wear shoe encounters an offset at a shaft guide splice joint, i.e. a slight misalignment of the adjoining vertical shaft guide sections (which sections may be misaligned by up to ¼). Without the taper, a blunt wear shoe edge that strikes the guide offset could result in serious damage to the wear shoe (e.g. peening of the edge). That in turn could interfere with the proper application of suitable clamping forces when the emergency brakes are engaged. In view of the tapered ends 273, 293, the exemplary wear shoes 270, 290 of the present embodiment have a generally trapezoidal longitudinal cross-sectional shape.

Figure 9:
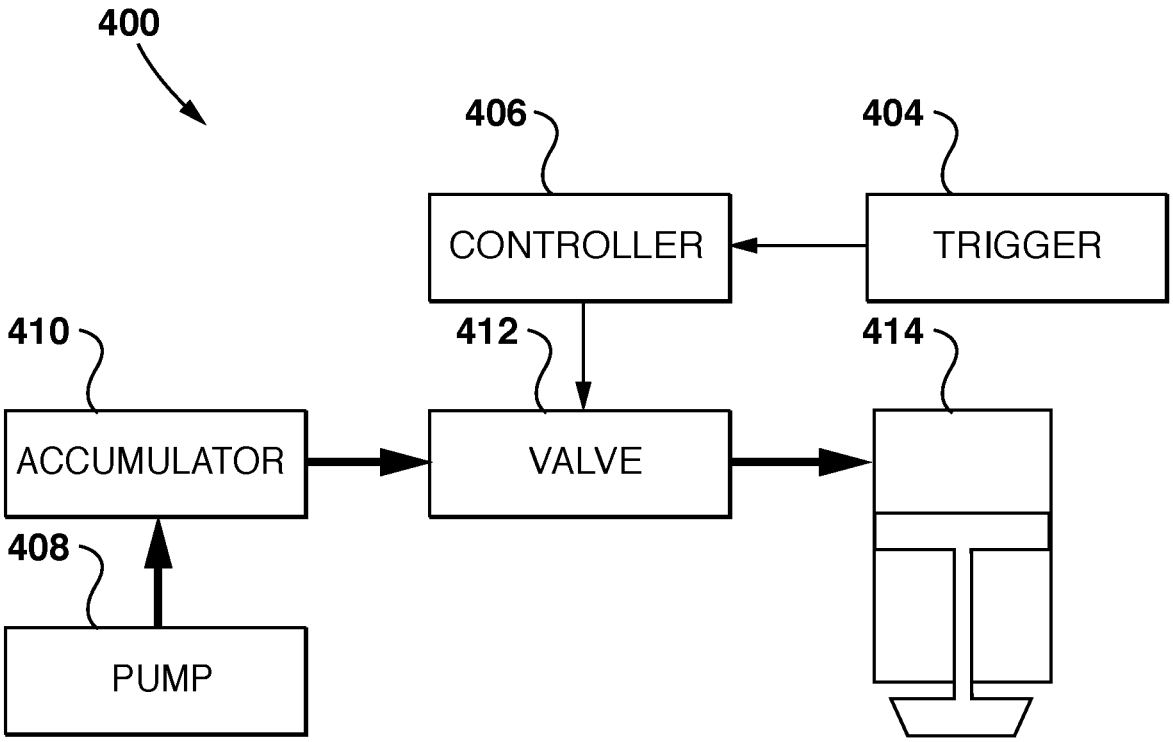
FIG. 9 is a simplified schematic block diagram of select electrical and hydraulic components of the emergency braking system of FIG. 1.

The emergency braking system 400 of the elevator car 100 is depicted schematically in FIG. 9. In particular, FIG. 9 is an example, simplified schematic block diagram of select electrical and hydraulic components of the emergency braking system 400. The components illustrated in FIG. 9 are associated with engaging a single one of the hydraulic brakes comprising a single clamp 200 (FIG. 2). Additional, analogous components, which are omitted from FIG. 9 for clarity, may be used for the other clamps.

FIG. 9 adopts the following conventions: boxes represent discrete electrical or hydraulic components; standard weight arrows between boxes represent electrical connections between components; and bold arrows between boxes represent hydraulic connections between components. The directionality of each arrow in FIG. 9 represents a direction of flow of the electrical signal or hydraulic fluid, respectively.

As illustrated, the components of emergency braking system 400 include a trigger 404, a controller 406, a pump 408, an accumulator 410, a valve 412, and a hydraulic cylinder 414 of an emergency brake. The system 400 may include additional components that are omitted from FIG. 9 for clarity and brevity. Although not depicted in FIG. 1, all of these elements of the emergency braking system 400 may be carried by the elevator car 100 (e.g. the components may sit atop elevator car roof 102).

The trigger 404 is a device that activates when the elevator car 100 enters a freefall or overspeed condition. The trigger may for example be an electrical switch, such as a rocker switch, toggle switch, proximity switch, or optical switch. The trigger 404 may for example be associated with a spring-loaded drawbar which activates the trigger 404 upon severance of a hoist rope. An example spring-loaded drawbar having one example type of trigger is described below.

The controller 406 is programmable logic controller (PLC) or similar controller that is responsible for sending appropriate control signals to a valve 412 (described below) for causing hydraulic fluid to flow for engaging the emergency brakes in the event of a freefall or overspeed condition of the elevator car 100. The controller 406 detects the freefall or overspeed emergency condition of the elevator car 100 by way of a signal from trigger 404. The PLC may be a commercially available PLC product, such as an Allen-Bradley™ PLC product for example. The PLC may be programmed to operate as described herein using ladder logic software. Use of PLC technology may be motivated by a desire to operate the emergency brake circuit efficiently and reliably. An alternative embodiment could have a "hard-wired" system that uses relay contactors to control the sequence logic.

Pump 408 is a pump for generating hydraulic pressure for powering hydraulic systems of emergency braking system 400. The pump 408 may be periodically activated by way of a "low-pressure" setting from an accumulator pressure switch. For example, as accumulator pressure reaches the low pressure setting, the pressure switch contacts may close and the hydraulic pump may be started. Once the accumulator pressure reaches a high pressure setting in this same switch, the contacts may open and the hydraulic pump may be shut off. In this way, hydraulic fluid in an accumulator 410, described below, may be pressurized. In the present embodiment, the pump 408 performs this pressurization in a "closed loop" fashion. In this context, "closed loop" refers a closed system in which hydraulic fluid is pressurized without introduction of ambient air. This is done to shield the system 400 from introduction of dirt or contaminants and to reduce or eliminate a risk of hydraulic fluid frothing, either of which may compromise proper operation of hydraulic components such as hydraulic valves or hydraulic brakes. The pump may be an electric pump, such as a standard gear pump manufactured by Parker Fluidpower™ being driven by a 1.5 hp-24 vDC electric motor.

Accumulator 410 is a vessel for storing pressurized hydraulic fluid that has been pressurized by pump 408 for use in quickly activating the hydraulic brakes in a freefall or overspeed elevator car condition. Accumulator 410 may for example be a commercially available Parker Fluidpower™ product, such as a bladder type accumulator having a one-gallon capacity.

Valve 412 is an electrically actuated hydraulic valve. The valve 412 is capable of opening or closing at a variety of different rates based on a received electrical control signal from controller 406. The valve 412 may actually comprise two subcomponent valves that cooperate to achieve that result, namely a hydraulic "dump" valve and a pilot pressure isolation valve. In some embodiments, a two-valve arrangement may be better suited than a single valve for ensuring proper valve control in view of the possibly extremely high pressure of hydraulic fluid within system 400. In some embodiments, the valve 412 may for example be, or may include, a directional hydraulic valve comprising a spool that is actuated by a solenoid or other actuator.

The emergency braking system 400 may also include a battery 170 (not expressly depicted in FIG. 9). The battery 170, which may sit atop the elevator car roof 102 e.g. as shown in FIG. 1, may power electrical components of system 400, including the pump(s), valve(s), and control system on the elevator car 100.

Figure 10:
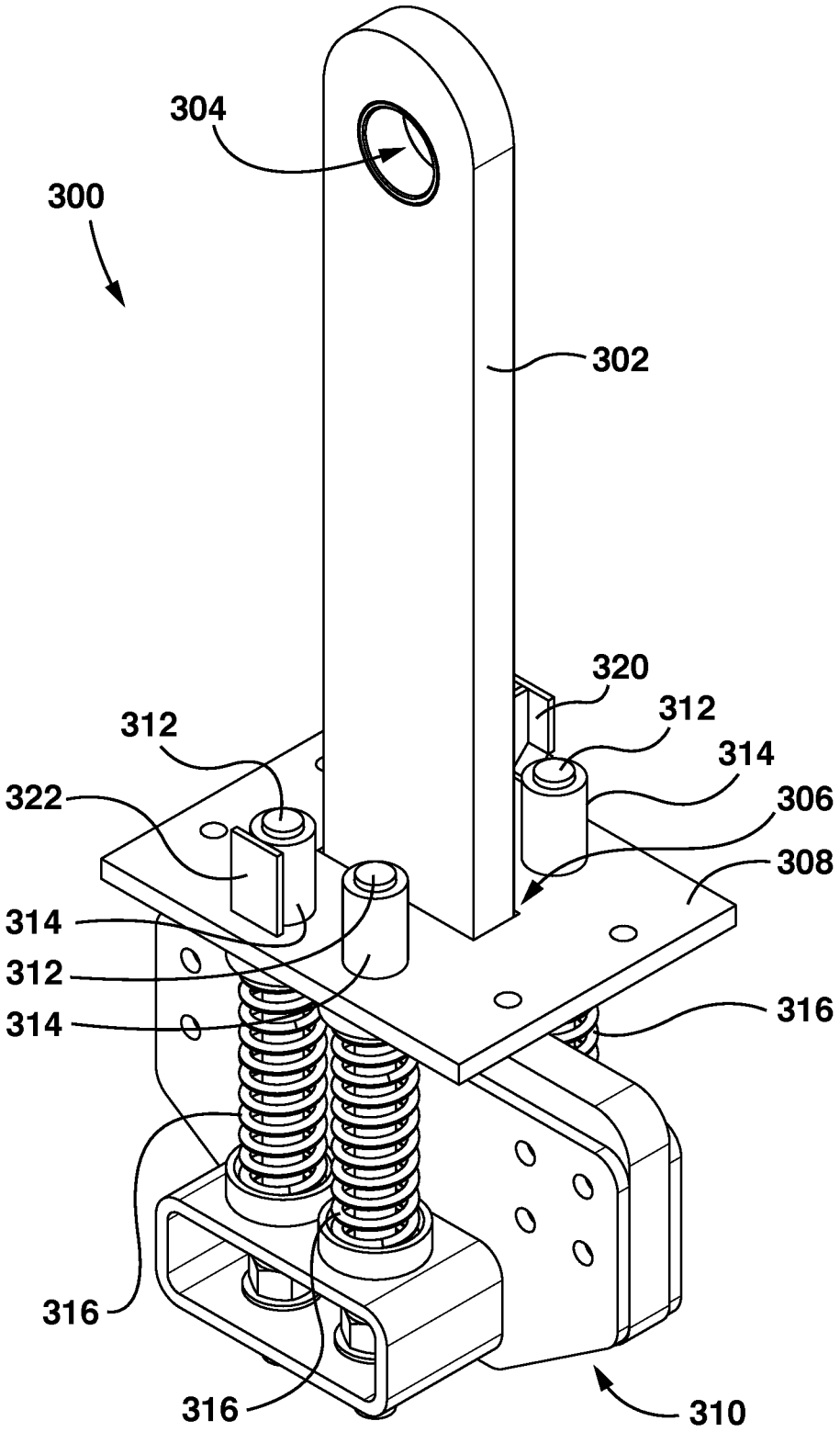
FIGS. 10 and 11 are perspective and side elevation views, respectively, of a drawbar component of the emergency braking system of FIG. 1 in a fully triggered state.
Figure 11:
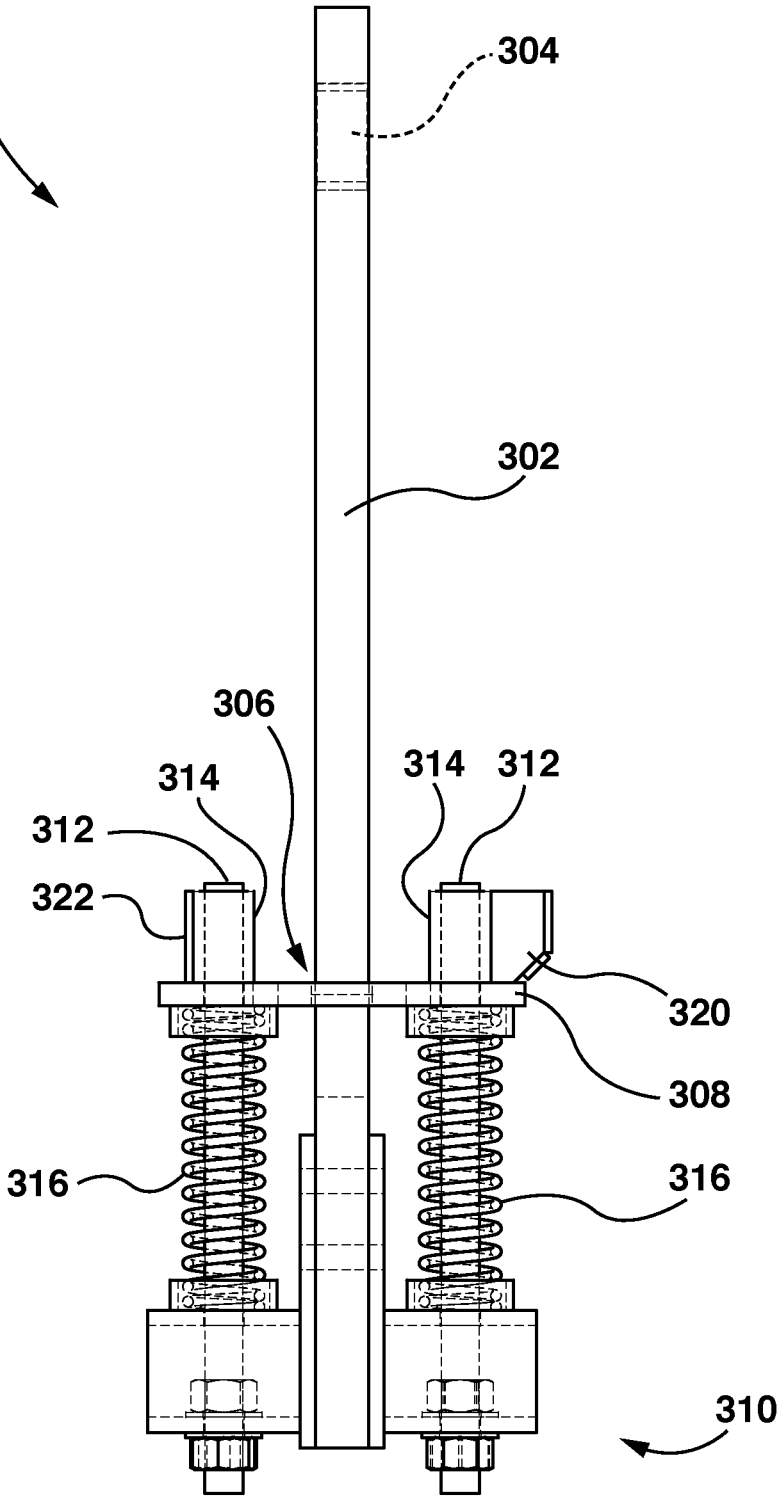
Figure 13:
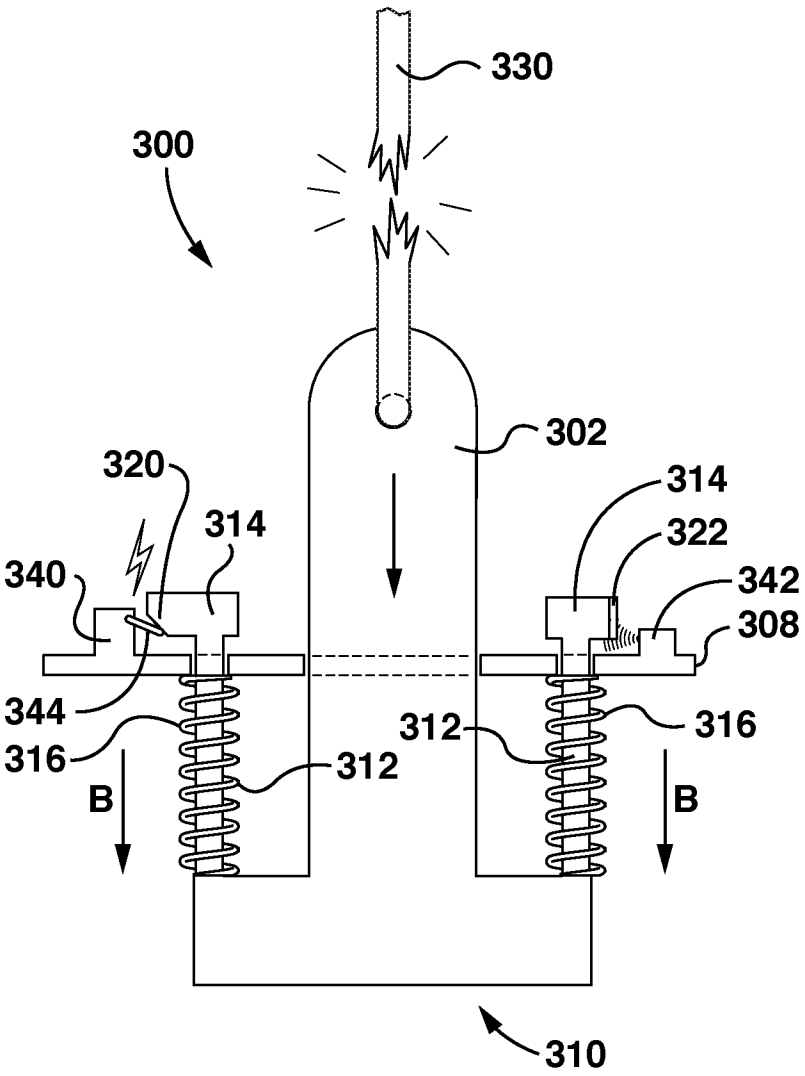
FIGS. 12, 13 and 14 are simplified schematic views of the drawbar of FIGS. 10 and 11 in an untriggered or normal use state, a first triggered state, and a second triggered state respectively.
Figure 12:
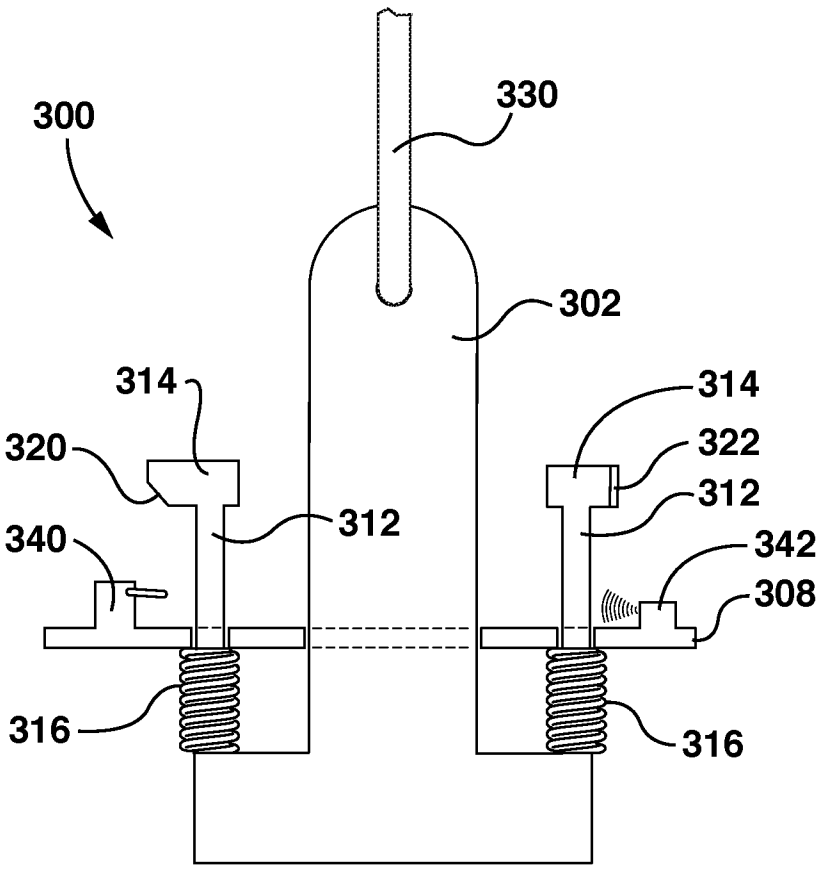
Figure 14:
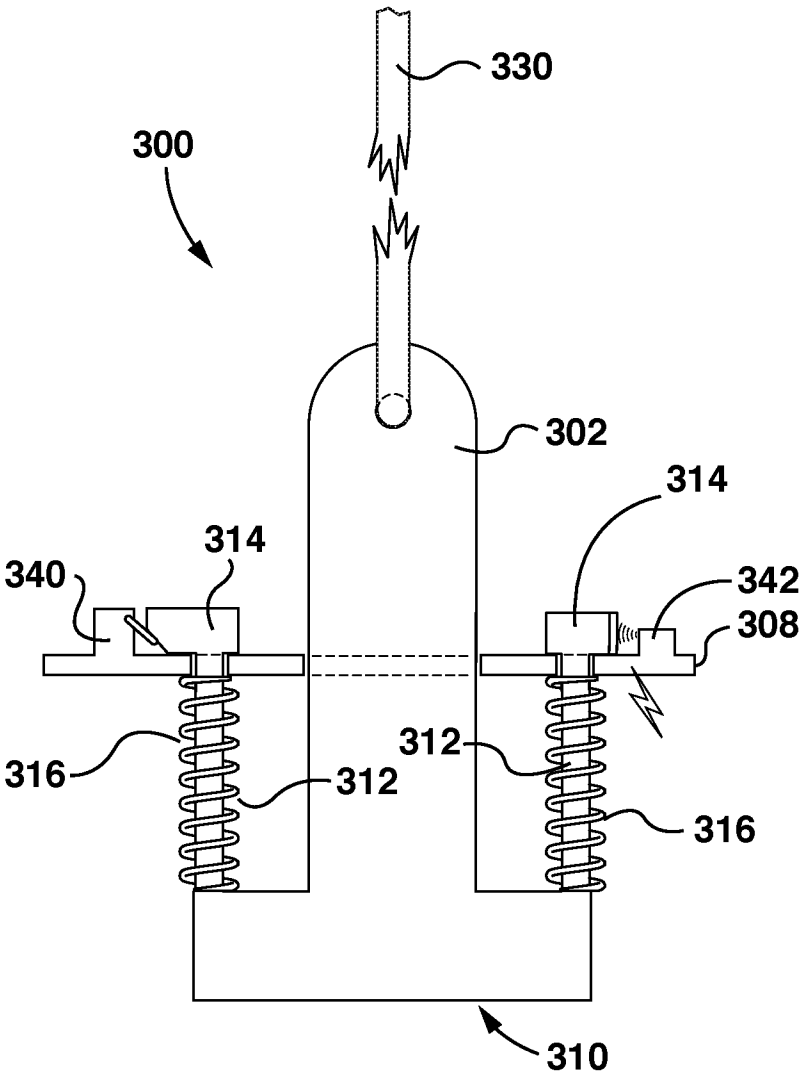

As noted above, the elevator car 100 of FIG. 1 is suspended from a hoist rope by way of a spring-loaded drawbar, which is attached to the roof 102 of the elevator car 100. An example spring-loaded drawbar 300 is illustrated in FIGS. 10-14. In particular, FIGS. 10 and 11 illustrate the example drawbar 300 in a fully triggered state, i.e. as it would appear some time after a hoist cable has been severed, in perspective and side elevation views respectively. In contrast, FIGS. 12-14 are simplified schematic views of the drawbar 300 in three respective states: an untriggered or normal use state; a first triggered state; and a second triggered state. The second triggered state of FIG. 14 corresponds to the fully triggered state depicted in FIGS. 10 and 11.

Referring to FIGS. 10 and 11, it can be seen that the drawbar 300 includes an upstanding tang 302 with a hole 304 at its distal end. The hole 304 is for attachment of a hoist cable. The tang 302 passes slidably or freely through a slot 306 in a horizontal plate 308 which may be attached to, or may form part of, the roof 102 of the elevator car 100 of FIG. 1.

A proximal (lower) end of tang 302 is fixedly attached to a base 310. Four upstanding posts 312 are also fixedly attached to the base 306 at their lowermost ends. The posts 312 flank the lower end of tang 302 on opposite sides, two per side. Each post 312 passes slidably or freely through a respective hole in plate 308 and has a limit 314 defined at its distal (uppermost) end. In the present embodiment, each limit 314 takes the form of a cap.

A coil spring 316 surrounds each of the posts 312. Each spring 316 is disposed or sandwiched between the underside of plate 308 and the top of base 310. The springs 316 thus collectively bias, with a biasing force B, the underside of limits 314 against the upper surface of the plate 308. As such, the limits 314 individually and collectively define a stop for limiting downward movement of the post 312 (and thus tang 302) relative to plate 308 (and thus elevator car roof 102). When the tang 302 is at this limit of movement (as in FIGS. 10 and 11), the drawbar 300 is considered to be in a "fully triggered" condition, i.e. as it may appear once the drawbar 300 reaches a steady state after a hoist cable has severed.

It will be appreciated that the springs 316 individually or collectively constitute a form of biasing element and that other forms of biasing elements, such as leaf springs, could be used in alternative embodiments.

As perhaps best see in FIG. 11, one of the limits 314 on one side of tang 302 (on the right hand side of FIG. 11) defines or fixedly attaches a first emergency braking trigger activator 320 or simply "first trigger activator 320." In the present embodiment, the first trigger activator 320 takes the form of a wing or ramp which flares or widens upwardly. The trigger 320 is designed to come into contact with and activate a toggle switch 340 (see FIG. 12) when the elevator car 100 enters a freefall or overspeed condition, in order to engage the emergency braking system.

Referring to FIGS. 10 and 11, another one of the caps 314, on the other side of tang 302 (on the left hand side of FIG. 11), defines or fixedly attaches a second emergency braking trigger activator 322 or simply "second trigger activator 322." In the present embodiment, the second trigger activator 322 takes the form an upstanding metal tab. The metal tab is designed to come into proximity with, and to thereby trigger, a proximity switch 342 (see FIG. 12), also when the elevator car 100 enters a freefall or overspeed condition.

In the present embodiment, the proximity switch 342 acts as a failsafe or backup switch for engaging the emergency braking system in the event that the toggle switch 340 fails. As such, the toggle switch 340 and the proximity switch 342 may be referred to as the primary and secondary braking activation switches, respectively. In this example, the primary and secondary braking activation switches collectively comprise the trigger 404 of FIG. 9.

In normal (i.e. non-freefall and non-overspeed) mine shaft elevator operating conditions, the elevator car 100 will be suspended from a hoist cable 330 by way of the tang 302 of drawbar 300 (see FIG. 12). Because the springs 316 support the plate 308 from underneath, and because plate 308 is attached to, or forms part of, the elevator car roof 102, the weight of the elevator car 100, and any cargo (human or otherwise), will be borne by the springs 316. The spring constant of the springs 316 is typically chosen so that the springs 316 compress at least partially under this weight, even when the elevator car 100 is empty. As a result, the distal ends of posts 312, and the majority of tang 302, will protrude upwardly through the plate 308 during normal operation. The first and second triggers 320, 322 at the distal ends of posts 312 will accordingly be well clear of their respective switches 340, 342 (see FIG. 12). As such, the emergency braking system will remain disengaged during normal elevator operation.

As the elevator car 100 is raised and lowered within the mine shaft by the hoist cable 330, the springs 316 may be compressed to the level that the shoulders on the lower end of the the tang 302 (which form part of base 310) contact the rest plate on the elevator car frame. The springs 316 are chosen so that, during such normal operation, the triggers 320, 322 will not contact their respective switches 340, 342 despite the fact that the springs 316 are compressed and thereby store energy.

In operation, in the event that the hoist cable 330 severs, e.g. as depicted in FIG. 13, then the elevator will enter a freefall condition. In that condition, the tang 302 will no longer be pulled upwardly by the cable 330. As a result, the tang 302 will suddenly be driven downwardly by the opposing biasing force B of the rebounding springs 316.

Before the tang 302 reaches the limit of its downward travel relative to plate 308 (as collectively defined by limits 314), the first trigger activator 320 will strike the roller arm 344 of the toggle switch 340 (see FIG. 13). This will cause the toggle switch 340 to close electrically. The closure of switch 340 is considered as a tripping of trigger 404 (FIG. 9). The tripping of trigger 404 is detected by controller 406 (FIG. 9) which, in response, activates the emergency braking system 400.

More specifically, controller 406 sends appropriate control signals to valve 412 to cause it to open at a particular rate. In some embodiments, this rate may be a predetermined rate that has been predetermined to cause the emergency brakes to activate acceptably quickly for the application in question. For example, in some embodiments in which human occupants are to be carried by the elevator car 100, "acceptably quickly" may mean a rate that results in a deceleration force of 32.2 ft/sec/sec (1 G) upon the elevator car 100 when the car carrying its maximum safe weight capacity. The appropriate rate for opening valve 412 to achieve this result may for example be empirically determined.

In some embodiments, opening valve 412 may be a multi-step process. For example, first, a hydraulic "dump" valve may be opened, causing a spool within the valve to shift. The shifting of the spool in that valve may permit pilot pressure isolation valves of accumulator 410 (FIG. 9) to drain. This may in turn cause the isolation valve spool to shift, which may permit high-pressure hydraulic fluid to leave the accumulator 410 and flow into the hydraulic cylinder 414 (FIG. 9). This process may be used to cause hydraulic fluid to flow into the hydraulic cylinders 250, 252 (FIGS. 6 and 7) on each clamp 130, 132, 134 and 136 (FIG. 1).

Pressurizing the hydraulic cylinders 250, 252 in turn causes the pistons 262, 282 to quickly move towards one another (FIG. 8) until wear shoes 270, 290 engage opposing surfaces of the shaft guide 294. The friction of this engagement dissipates kinetic energy as heat, eventually bringing the elevator car 100 to a stop.

Once the tang 302 reaches the absolute limit of its downward travel relative to plate 308 (see FIG. 14), the second trigger 322 will be positioned proximately to the secondary proximity switch 342. This will cause the proximity switch 342 to close electrically. The closure of switch 342 will activate the emergency braking system 400, as described above, in the event that closure of toggle switch 340 has failed to do so. This is done for redundancy and robustness. It is not absolutely required to have such a redundant switch in alternative embodiments.

Figure 15:
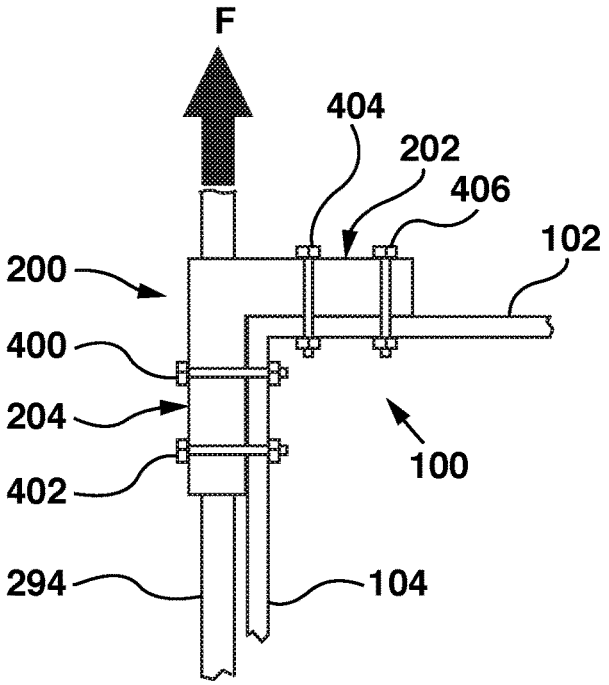
FIG. 15 is a schematic side view of the clamp of FIG. 2 attached to an elevator car adjacent to a mine shaft guide.

As alluded to above, the L-shaped profile of the clamp 200 may enhance the ability of the clamp 200 to withstand significant G forces during emergency braking with minimal equipment damage or wear. Referring to FIG. 15, there is depicted a schematic side view of an L-shaped clamp 200 attached to an elevator car 100 adjacent to a mine shaft guide 294. As described above, the example clamp 200 is attached at a right angle junction of the roof 102 and wall 104 of the elevator car 100.

In particular, as shown in FIG. 15, the horizontal portion 202 of the clamp is attached to the elevator car roof 102 at a plurality of attachment points, and the vertical portion 204 of the clamp is attached to elevator car wall 104 at a plurality of attachment points. The attachment points may be designed to accommodate fasteners, such as bolts. Four example fasteners 400, 402, 404 and 406 are depicted in FIG. 15 for the sake of illustration. It will be appreciated that a different number or type of fasteners may actually be used, or that attachment may be performed at multiple points without fasteners (e.g. via welding).

When the emergency brakes of clamp 200 are applied to the shaft guide 294 while the elevator car 100 is in a freefall or overspeed condition, the deceleration will impart a sudden upward force F upon the clamp 200. As shown in FIG. 15, this force will be applied upwardly largely in line with the vertical portion 204 of the clamp 200. As such, the force F will be a shear force relative to the vertical portion 204 of the clamp and relative to fasteners 400 and 402. Although some portion of force F may also act as a tension force upon the horizontal portion 202 and fasteners 404 and 406, that portion will not be the entirety of force F. This design may accordingly result in less wear upon the clamp 200 or fasteners 400, 402, 404 and 406 over time than other designs.

Figure 16:
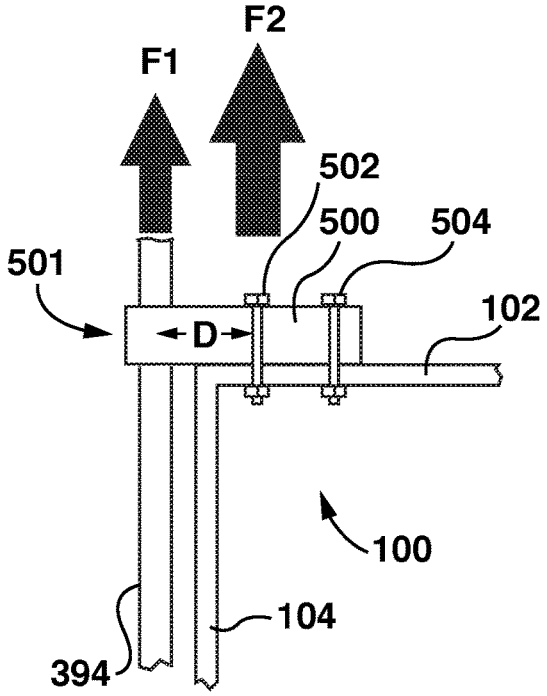
FIGS. 16 and 17 are schematic side views of a hypothetical alterative clamp attached to an elevator car adjacent to a mine shaft guide at two different points in time.
Figure 17:
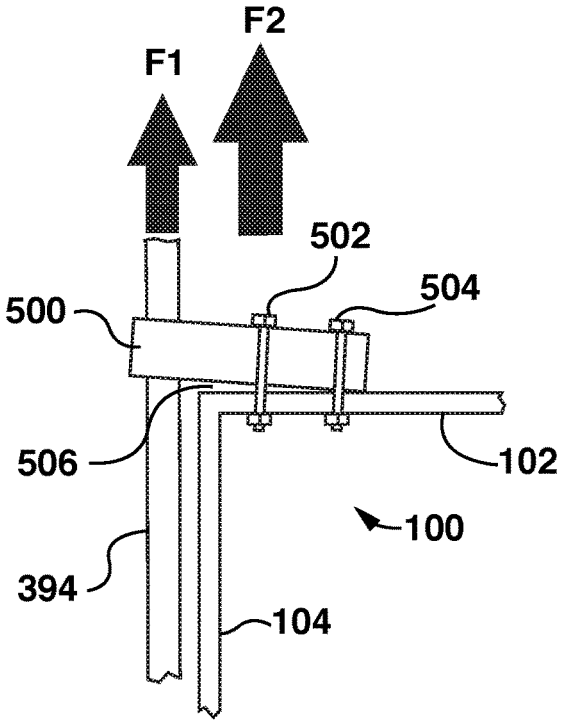

For example, a hypothetical alternative clamp design is depicted in FIGS. 16 and 17. As shown in those figures, the alternative clamp 500 has simple cuboid shape. The body of the clamp 500 is designed for attachment to the roof 102 of the elevator car 100 using example fasteners 502, 504. A distal portion 501 of the clamp 500, housing one or more brakes (not depicted), extends from or overhangs an edge of roof 102 so as to position the brake(s) adjacent to mine shaft guide 394.

Should the brake(s) of hypothetical clamp 500 be applied in a freefall or overspeed condition, the deceleration would impart a sudden upward force F1 upon the overhanging distal portion of the clamp 500. This force F1 would act largely or fully as a tensile force, or upward prying force, upon the body of clamp 500 and fasteners 502, 504. Moreover, in view of the distance D between the point at which the force F1 is applied and the first fastener 502, the tensile force F2 experienced at fastener 502 may be magnified relative to F1, due to the lever principle of physics, e.g. if the rightmost edge of the clamp body acts as a fulcrum.

Over time, repeated applications of this magnified tensile force F2 upon fastener 502 may cause the fastener to weaken or fail. This may in turn cause the clamp 500 to become loose, with a gap 506 possibly forming between the elevator car 100 and the clamp 500 (see FIG. 17). The looseness of the hypothetical clamp 500 may worsen over time and may eventually necessitate clamp reattachment or replacement, which would involve undesirable elevator downtime and may increase costs.

The disclosure above describes how the emergency braking system 400 is triggered when an elevator car enters a freefall condition upon the severing of the hoist rope. It will be appreciated that the emergency braking system 400 could be triggered in the same way should the elevator car enter an overspeed condition not involving severing of the rope, e.g. upon the hang-up and subsequent limited-distance drop of the elevator car 100 within the mine shaft during descent.

Various alternative embodiments are possible. For example, some embodiments of emergency braking system may be designed to incrementally activate the emergency brakes at different rates based upon the load currently being borne by the elevator car. This may be done with a view to stopping the elevator car without subjecting it to unacceptably high or unsafe G forces regardless of whether it is heavily loaded or lightly loaded. Such an alternative embodiment is depicted in FIG. 18.

Figure 18:
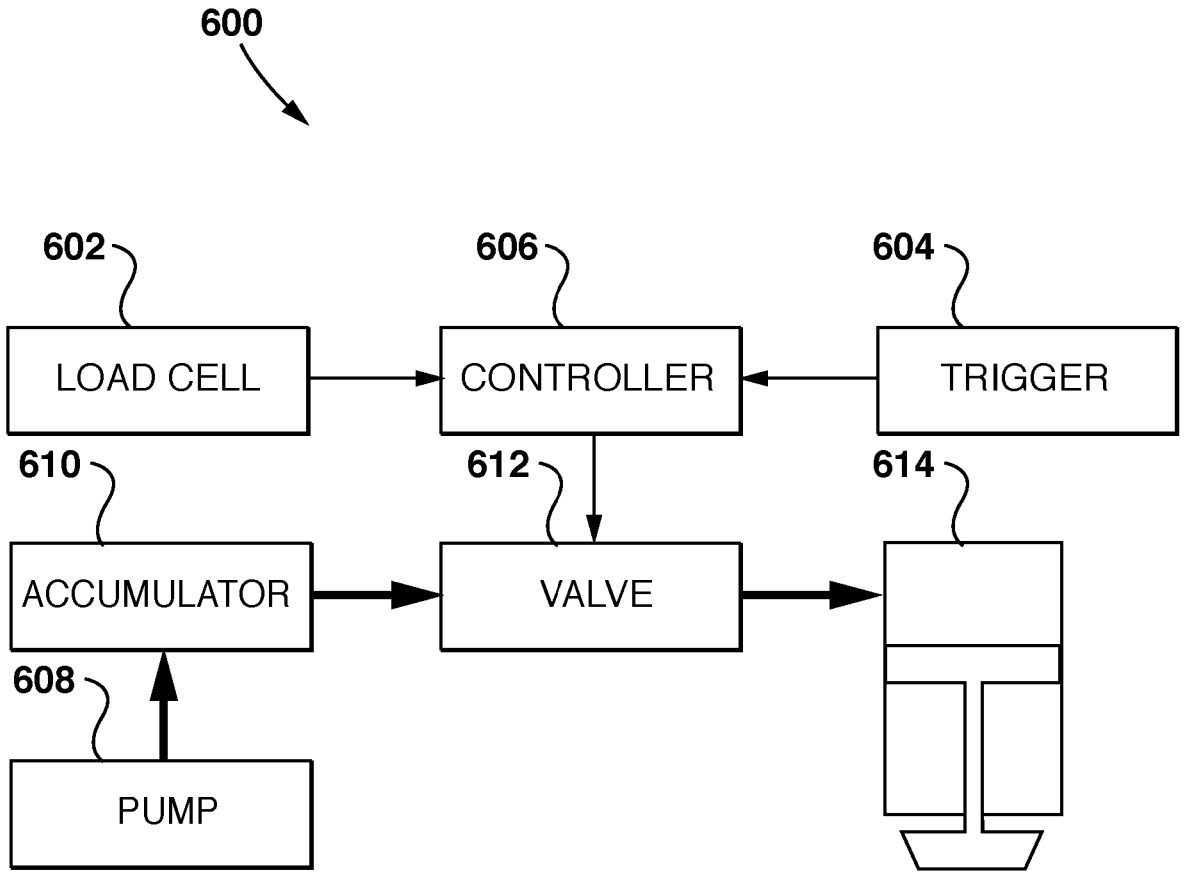
FIG. 18 is a simplified schematic block diagram of select electrical and hydraulic components of an alternative embodiment of emergency braking system.

FIG. 18 is a simplified schematic diagram of an emergency braking system 600. In particular, the components illustrated in FIG. 18 are associated with engaging a single one of the hydraulic brakes comprising a single clamp 200 (FIG. 2). Additional, analogous components, which are omitted from FIG. 18 for clarity, may be used for the other clamps.

FIG. 18 adopts the same conventions as FIG. 9, described above. As illustrated in FIG. 18, the emergency braking system 600 include a trigger 604, a controller 606, a pump 608, an accumulator 610, a valve 612, and a hydraulic cylinder 614 of an emergency brake. Each of these components serves essentially the same function, and has the same general interrelationships with other system components, as the correspondingly named components of FIG. 9, and thus will not be described anew.

The emergency braking system 600 of FIG. 18 includes an additional component not depicted in the emergency braking system 400 of FIG. 9, namely load cell 602. The load cell 602 is a component that periodically senses a load of the elevator car and sends an electrical signal corresponding to the sensed load to the controller 604.

Figure 19:
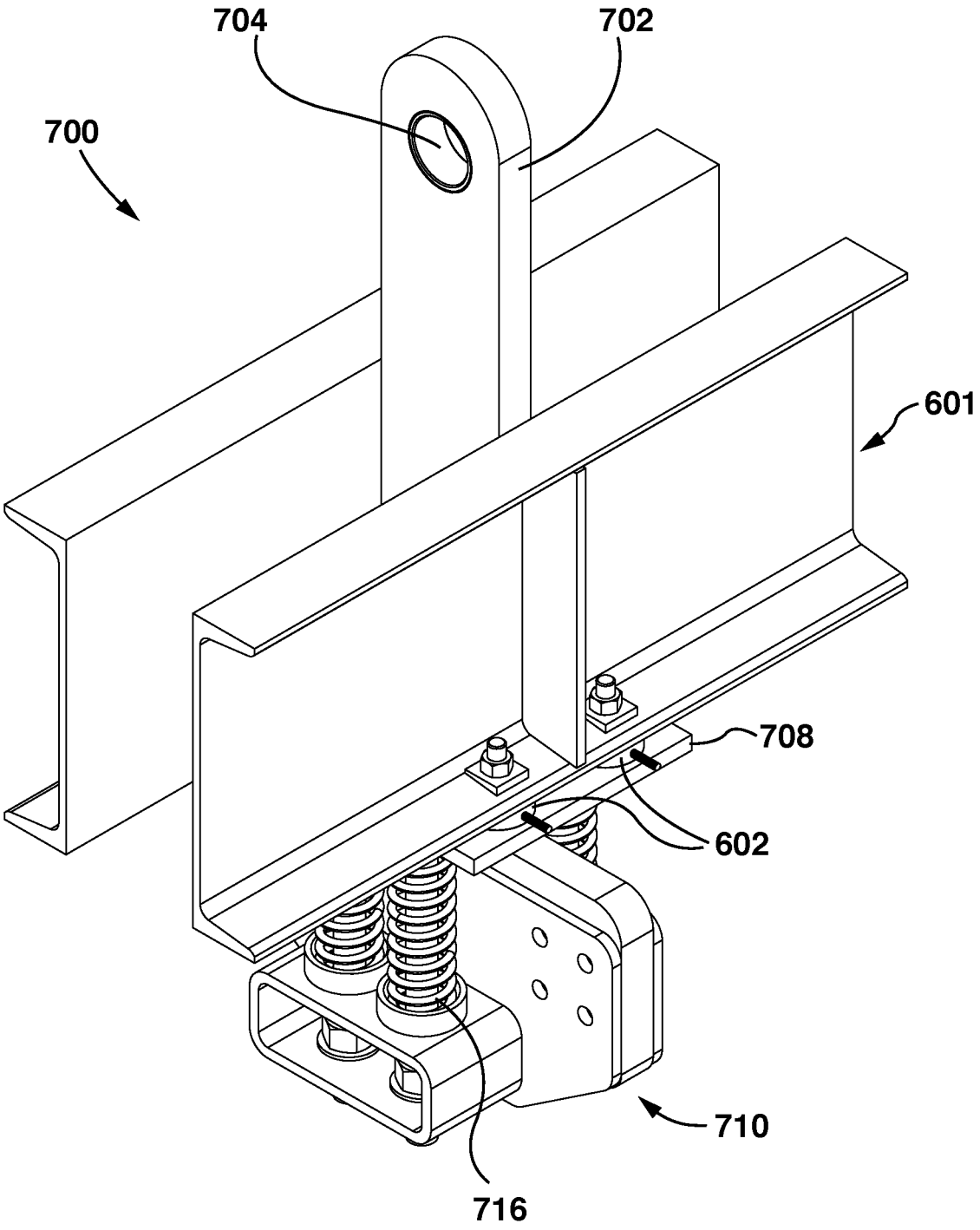
FIGS. 19, 20 and 21 are a perspective, side elevation, and front elevation view, respectively, of an alternative spring-loaded drawbar forming part of an alternative emergency braking system.
Figure 20:
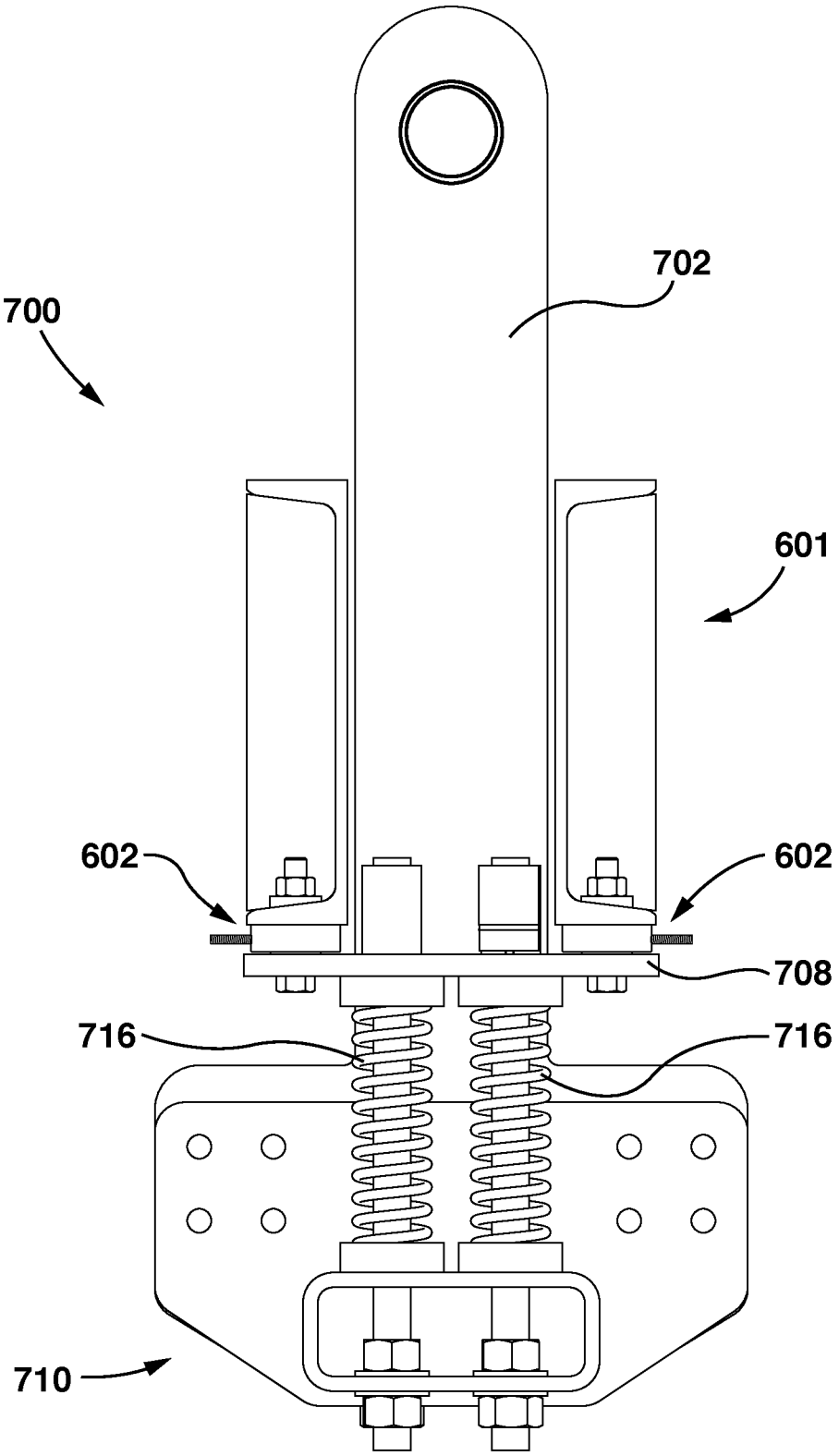
Figure 21:
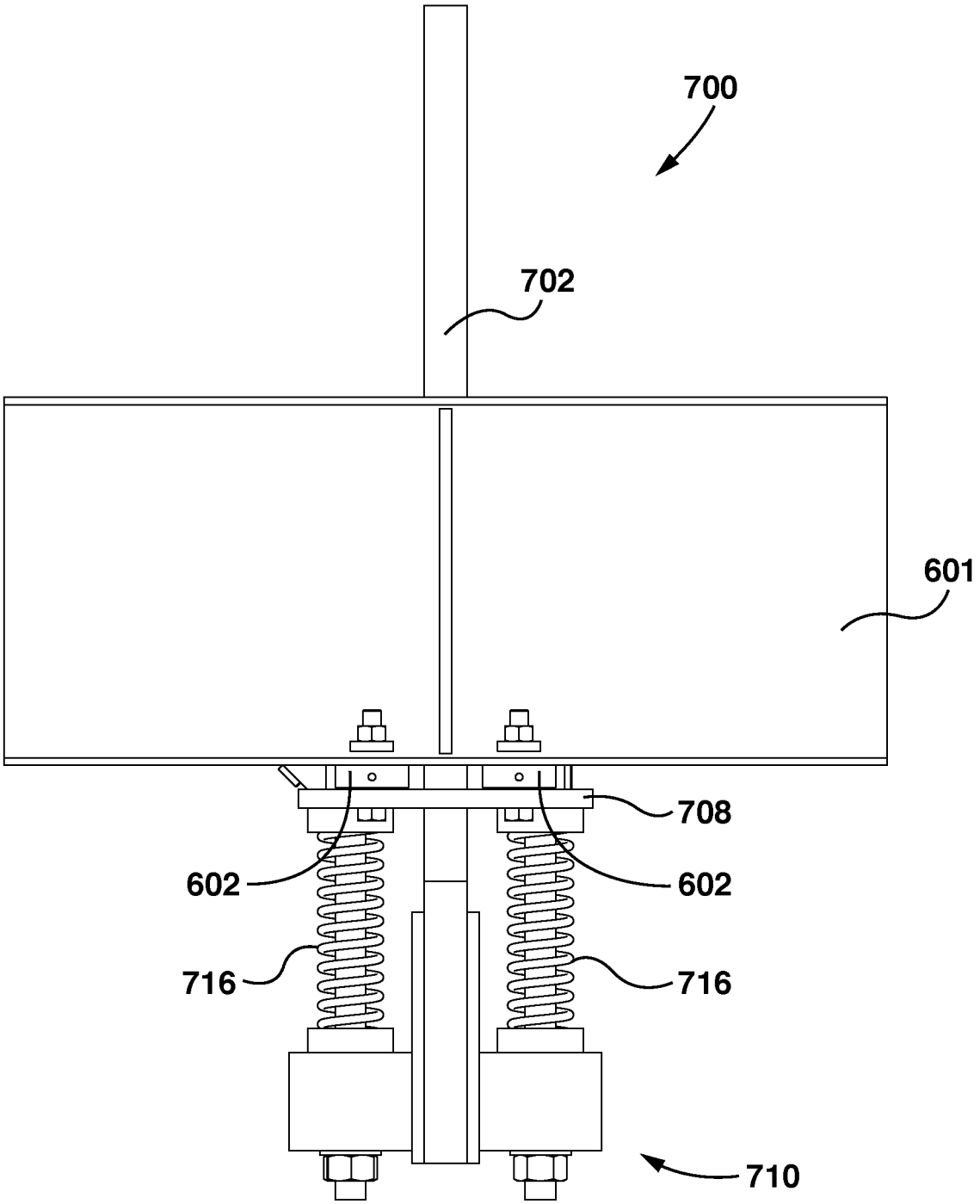

An example of a spring-loaded drawbar 700 which incorporates a load cell 602 is illustrated in FIGS. 19-21, in perspective, side elevation, and front elevation view respectively. The drawbar 700 is of a similar design to the drawbar 300 of FIGS. 10 and 11, including a tang 702 with hole 704 for a cable, a base 710, and springs 716. These components serve similar purposes to the components of drawbar 300 of the same name, described above.

One additional component of drawbar 700, which does not have a counterpart in drawbar 300 described above, is load cell 602. Load cell 602 is a sensor (or, in this example, multiple sensors) that generates signals indicative of a load of the elevator car. The load cells 602 may be sandwiched between a plate 708 and the flanges of a head channel 601 for example.

Referring to FIG. 18, the controller 606 periodically receives a sensed load signal from the load cell 602 (e.g. when the elevator car is stationary and the emergency brakes are disengaged) and stores a value in a memory (not expressly depicted) indicative of the sensed load. This value allows the controller 606 to dynamically determine the rate at which to incrementally engage the emergency brakes (i.e. to dynamically set the incremental brake engagement rate) based, at least in part, upon the load of the elevator car as sensed by the load cell. In particular, the controller 606 (FIG. 18) may be operable to dynamically set the incremental brake engagement rate to be faster for a heavier sensed load of the elevator car than for a lighter sensed load of the elevator car. For example, the controller 606 may be operable to dynamically set the incremental brake engagement rate to be proportional to a magnitude of the sensed load of the elevator car.

For example, in the example drawbar 700 of FIGS. 19-21, the load cells 602 may generate signals collectively indicative of the load of the elevator car based on strain from applied force (sensed weight). A summation module in the controller 606 may sum the individual load cell signals to provide an indication of the total elevator car weight with cargo. This value may be compared to preset ranges of values having associated preset values representing an appropriate rate at which to dynamically engage the brakes (or, more specifically to this embodiment, to dynamically open the valve 612 of FIG. 18). The volume and speed of hydraulic oil release can thus be controlled to provide an incremental brake engagement rate that is tailored to the load being decelerated.

Other variations are possible. For example, the example clamp 200 of FIG. 2 has an L-shaped profile for attaching the clamp at junction of a cage wall and a cage roof. It is possible that alternative embodiments of clamp could have an L-shaped profile for attaching the clamp at a junction of a cage wall and a cage floor or deck. In that case, the horizontal portion of the clamp body may be for attachment to the elevator car floor or deck. A pair of opposing brakes may be disposed on the vertical portion of the clamp body so as to be disposed mostly or entirely above the horizontal portion of the clamp body. In this case, the cage structure would go into a compression mode during a capture event, i.e. during emergency deceleration. This may be advantageous when carrying extremely heavy payloads on the cage floor or deck.

The trigger used to trigger the emergency braking system need not necessarily be a rocker switch or a proximity switch and need not utilize redundant switches.

It is not absolutely required for the brakes to be hydraulic brakes as disclosed above in every embodiment. For example, in alternative embodiments, the brake shoes could be spring-applied through the use of Belleville spring stacks positioned immediately behind the brake shoe with the brake shoe being held in a disengaged position by hydraulic pressure. To engage the brakes, the hydraulic force may be removed, thereby allowing the spring stacks to extend.

The emergency braking systems, clamps, and methods described above may be used with virtually any type of mine shaft conveyance, including elevator cars for carrying cargo (possibly referred to as "skips"), elevator cars for carrying human occupants, or elevator cars for carrying both cargo and human occupants.

The following clauses describe additional aspects of the present disclosure.

Clause 1. An emergency braking system for a mine shaft conveyance, the system comprising: a brake; a control system for, upon detection of a mine shaft conveyance freefall or overspeed condition, incrementally engaging the brake at an incremental brake engagement rate; and a load cell, coupled to the control system, for sensing a load of the mine shaft conveyance, wherein the control system is operable to dynamically set the incremental brake engagement rate based, at least in part, upon the load of the mine shaft conveyance as sensed by the load cell.

Clause 2. The emergency braking system of clause 1 wherein the control system is operable to dynamically set the incremental brake engagement rate to be faster for a heavier sensed load of the mine shaft conveyance than for a lighter sensed load of the mine shaft conveyance.

Clause 3. The emergency braking system of clause 1 wherein the control system is operable to dynamically set the incremental brake engagement rate to be proportional to a magnitude of the sensed load of the mine shaft conveyance.

Clause 4. A method of activating an emergency brake of a mine shaft conveyance, the method comprising: sensing a load of the mine shaft conveyance; based on the sensed load of the mine shaft conveyance, dynamically determining a rate at which an emergency brake shall be incrementally engaged; and upon detecting a freefall or overspeed condition of the mine shaft conveyance, incrementally engaging the emergency brake at the dynamically determined rate Clause 5. The method of clause 4 wherein the dynamic determining sets the rate at which the emergency brake shall be incrementally engaged to be slower for a lighter sensed load of the mine shaft conveyance than for a heavier sensed load of the mine shaft conveyance.

Clause 6. The method of clause 4 wherein the dynamic determining sets the rate at which the emergency brake shall be incrementally engaged proportionally to the sensed load of the mine shaft conveyance.

Other modifications may be made within the scope of the following claims.

What is claimed is:

1. A clamp for installation at a right angle junction of a roof and an adjacent wall of a substantially cuboid-shaped mine shaft conveyance as part of an emergency braking system of the mine shaft conveyance, the clamp comprising:

a pair of L-shaped brackets, in like orientation and occupying parallel planes, spaced apart in fixed relation to one another; and a pair of opposing brakes disposed on corresponding respective legs of the pair of L-shaped brackets, the pair of opposing brakes for clamping a mine shaft guide between the brakes for emergency braking;

wherein the corresponding legs of the pair of L-shaped brackets on which the pair of opposing brakes is disposed are attached to a first plate defining a vertical mounting face of the clamp and wherein the remaining two legs of the pair of L-shaped brackets are attached to a second plate defining a horizontal mounting face of the clamp; and wherein the vertical mounting face meets the horizontal mounting face at a right angle to facilitate mounting of the clamp to the mine shaft conveyance at the right angle junction of the roof and the wall of the mine shaft conveyance through attachment of the horizontal mounting face to the roof of the mine shaft conveyance and attachment of the vertical mounting face to the wall of the mine shaft conveyance.

2. The clamp of claim 1 wherein the pair of L-shaped brackets, the first plate, and the second plate are all made from the same material and wherein each of the L-shaped brackets is at least six times thicker than a thickest one of the first plate and the second plate.

3. The clamp of claim 1 wherein each of the pair of opposing brakes comprises a wear shoe having a flat face and wherein the flat face of each wear shoe occupies a plane that is perpendicular to both of the vertical mounting face of the clamp and the horizontal mounting face of the clamp.

4. The clamp of claim 3 wherein each wear shoe has tapered ends so that the wear shoe will serve as a guide shoe with respect to the mine shaft guide when the brake is not engaged.

5. The clamp of claim 1 wherein each of the brakes comprises:

a brake shoe comprising:

a wear shoe mount plate;

a sole piston extending orthogonally and centrally from a back face of the wear shoe mount plate; and a pair of alignment pins flanking the piston and extending orthogonally from the back face of the wear shoe mount plate; and a sole cylinder associated with the sole piston for causing the brake shoe to move.

6. The clamp of claim 5 wherein the clamp body comprises a respective guide hole for slidably receiving each of the alignment pins.

7. The clamp of claim 6 wherein the geometric tolerance of each of the alignment pins with respect to its respective guide hole is approximately one twenty thousandth to one ten thousandth of an inch.

8. The clamp of claim 6 wherein the linear tolerance of each of the alignment pins with respect to its respective guide hole is approximately several thousandths of an inch.

9. The clamp of claim 1 wherein the pair of opposing brakes is disposed on the corresponding respective legs of the pair of L-shaped brackets so as to be mostly or entirely below the second plate defining the horizontal mounting face of the clamp body when installed at the right angle junction of the roof and wall of the mine shaft conveyance.

10. The clamp of claim 1 wherein each of the pair of opposing brakes comprises a hydraulic cylinder mounted horizontally onto the first plate of the clamp body, on an opposite side from the vertical mounting face, so that, upon installation of the clamp at the right angle junction of the roof and adjacent wall of the mine shaft conveyance, the hydraulic cylinder will be lower than a top surface of the roof.

11. The clamp of claim 1 wherein each of the first plate defining the vertical mounting face and the second plate defining the horizontal mounting face defines a plurality of attachment points for attachment to the wall and roof, respectively, of the mine shaft conveyance.

12. A method of installing an emergency braking system onto a substantially cuboid-shaped mine shaft conveyance, the method comprising:

positioning a clamp at a right angle junction of a roof and an adjacent wall of the mine shaft conveyance, the clamp including:

a pair of L-shaped brackets, in like orientation and occupying parallel planes, spaced apart in fixed relation to one another; and a pair of opposing brakes disposed on corresponding respective legs of the pair of L-shaped brackets, the pair of opposing brakes for clamping a mine shaft guide between the brakes for emergency braking;

wherein the corresponding legs of the pair of L-shaped brackets on which the pair of opposing brakes is disposed are attached to a first plate defining a vertical mounting face of the clamp and wherein the remaining two legs of the pair of L-shaped brackets are attached to a second plate defining a horizontal mounting face of the clamp, the vertical mounting face meeting the horizontal mounting face at a right angle;

attaching the vertical mounting face to the wall of the mine shaft conveyance; and attaching the horizontal mounting face to the roof of the mine shaft conveyance.

* * * * *